United States Patent [19]

LaManna et al.

[11] 4,271,012

[45] Jun. 2, 1981

[54] AUTOMATIC EMBOSSING SYSTEM

[75] Inventors: Richard J. LaManna, Whippany; Jacob H. Drillick, Hawthorne, both of N.J.; Michael D. Polad, Mendota, Minn.

[73] Assignee: Data Card Corporation, Minnetonka, Minn.

[21] Appl. No.: 18,279

[22] Filed: Mar. 7, 1979

Related U.S. Application Data

[62] Division of Ser. No. 835,406, Sep. 21, 1977, Pat. No. 4,180,338, which is a division of Ser. No. 720,071, Sep. 2, 1976.

[51] Int. Cl.[3] ..... B07C 9/00

[52] U.S. Cl. ..... 209/653; 271/64; 271/181; 414/108

[58] Field of Search ..... 209/606, 651, 653; 271/64, 180, 181; 414/103, 108, 907

[56] References Cited

U.S. PATENT DOCUMENTS

| | | | |
|---|---|---|---|
| 1,762,927 | 6/1930 | Manny | 271/181 |
| 3,266,798 | 8/1966 | Bleiman | 271/64 |

*Primary Examiner*—Joseph J. Rolla
*Attorney, Agent, or Firm*—Staas & Halsey

[57] ABSTRACT

Automatic card embossing apparatus includes a rotatable embossing wheel carrying about its periphery punch and die pairs for all characters available for embossing. Each character position of the wheel defines an address and the wheel is controlled for rotation to a desired address for embossing the character therelocated. Data identifying all embossable characters is processed to derive three control numbers for each character, the first control number identifying the corresponding wheel address for the corresponding punch and die pair, the second number identifying the horizontal position on the card where the character is to be embossed, and the third control number identifying the line number on the card. The data is sorted into ascending order of wheel addresses. In operation, a card is transported to a reference position relative to the embossing wheel and the embossing wheel is rotated to the address of the first control number. The distance to move the card based on the second and third control numbers is computed, and the card is transported to each successive position for that first character to be embossed. The embossing wheel then is rotated to the next address in accordance with the next first control number and the embossing and card transport functions are performed. Following embossing, the card is returned to its reference position, then to an output stacker where it is deflected into "accept" or "reject" portions as a function of error checks performed during data processing and embossing.

7 Claims, 29 Drawing Figures

AUTOMATIC EMBOSSING SYSTEM

This is a division of application Ser. No. 835,406 filed Sept. 21, 1977, now U.S. Pat. No. 4,180,338 which is a division of application Ser. No. 720,071 filed Sept. 2, 1976.

Cross-reference is herein made to U.S. Pat. No. 3,638,563 of Feb. 1, 1972, assigned to the same assignee as this application.

BACKGROUND OF THE INVENTION

1. Field of the Invention

This invention relates to an automatic embossing system and, more particularly, to such a system for embossing multiple lines of characters on a medium such as a common credit card and for performing such embossing and other related functions on the medium under automated control and in response to data input from an external source.

2. State of the Prior Art

Automated embossing systems have found wide acceptance in the field. Two such systems are disclosed in U.S. Pat. Nos. Re. 27,809—Drillick and 3,820,455—Hencley et al. The systems of each of these patents are, relative to that of the present invention, high speed systems of substantial size and expense. Whereas such systems are ideally suited for high volume production of credit cards, they do not necessarily meet the requirements of low volume production, at least in view of cost and size factors.

The system of U.S. Pat. No. Re. 27,809 employs linear arrays of embossing elements, one embossing module being assigned the task of embossing characters on a single, corresponding embossing line of a card. As the card is transported past each module, in succession, the characters required to be embossed on each successive line of the card are embossed as the card is presented to the appropriate punch and die pair of that module, for each position on which that character is to appear on that line. The data processing requirements therefore must sort the data to be embossed in relation to the line on the card and the module to emboss that line and, for each such line, the position of each character in the succession in which it is provided in the embossing punch and die pairs of the module relative to the locations at which that character appears on that line. A very high through-put rate of cards is achieved in this equipment.

A somewhat lower cost system is disclosed in U.S. Pat. No. 3,820,455 with a somewhat reduced through-put rate. In this system, only a single embossing module, again with the punch and die pairs in a linear array, is employed. In this system, each card is transported past the module in a first direction parallel to the lines of character embossing to be provided on the card to successive index positions and, at each such index position, in a transverse direction such that the multiple embossing lines of each card are presented in succession to the row or array of character embossing elements for each index position in succession. Suitable sorting of the data to correlate the data to be embossed on the card with the position of the card relative to the embossing characters is performed, whereby the multiple lines of embossed characters are produced on the card during a single such path of motion of the card past the embossing elements.

In each of the above systems, plural characters may be required to be embossed simultaneously at a given card position. This is not only consistent with the desired through-put rates to be attained, but also is required by the path of motion of the card past the embossing elements. The general configuration of the equipment and particularly the fixed linear array or row of embossing elements in conjunction with the requisite capability of potential for simultaneously embossing plural characters, results in equipment of rather substantial size and weight, the latter particularly in view of mechanical strength requirements to accommodate the forces necessary for plural simultaneous embossing operations. Such characteristics, on the other hand, contribute to the high through-put rates which this prior art equipment achieves.

Heretofore in the prior art, however, the above automated embossing equipment and other such equipment as is available has not satisfied the needs of low volume users, principally due to the desire of such users to have equipment which is smaller in physical size and concommitantly lighter in weight and which correspondingly is of lower cost, such users being readily willing to accept a lower through-put rate in line with their operating requirements.

OBJECTS OF THE INVENTION

Accordingly, it is an object of this invention to provide automatic embossing apparatus which is of reduced size and weight relatively to that available heretofore in the prior art yet which can perform embossing of media such as credit cards in a fully automated manner.

Yet another object of the invention is to provide an automated embossing system of reduced physical size and weight and reduced cost.

Still a further object of this invention is to provide an embossing system which is of low cost yet highly efficient and effective in operation.

Yet another object of this invention is to provide an embossing system which utilizes a rotary embossing wheel carrying the punch and die pairs to be embossed yet which minimizes the movement of the embossing wheel such that all characters capable of being embossed may be selected and embossed at all available embossing locations on the medium to be embossed, for example a credit card, in but one revolution of the embossing wheel.

Still another object of this invention is to provide an automatic embossing system wherein the lowest momentum and lowest inertia element therein, namely the credit card, is moved most rapidly and most often in its lowest inertia directions of motion, in succession, and ultimately the highest inertia portion of the embossing system comprising the embossing elements themselves are moved the least, thereby to minimize design requirements while maintaining the maximum possible efficiency of operation and through-put rate.

These and other objects of the invention will become more apparent with reference to the following figures and detailed description, wherein:

SUMMARY OF THE INVENTION

Figure 1:
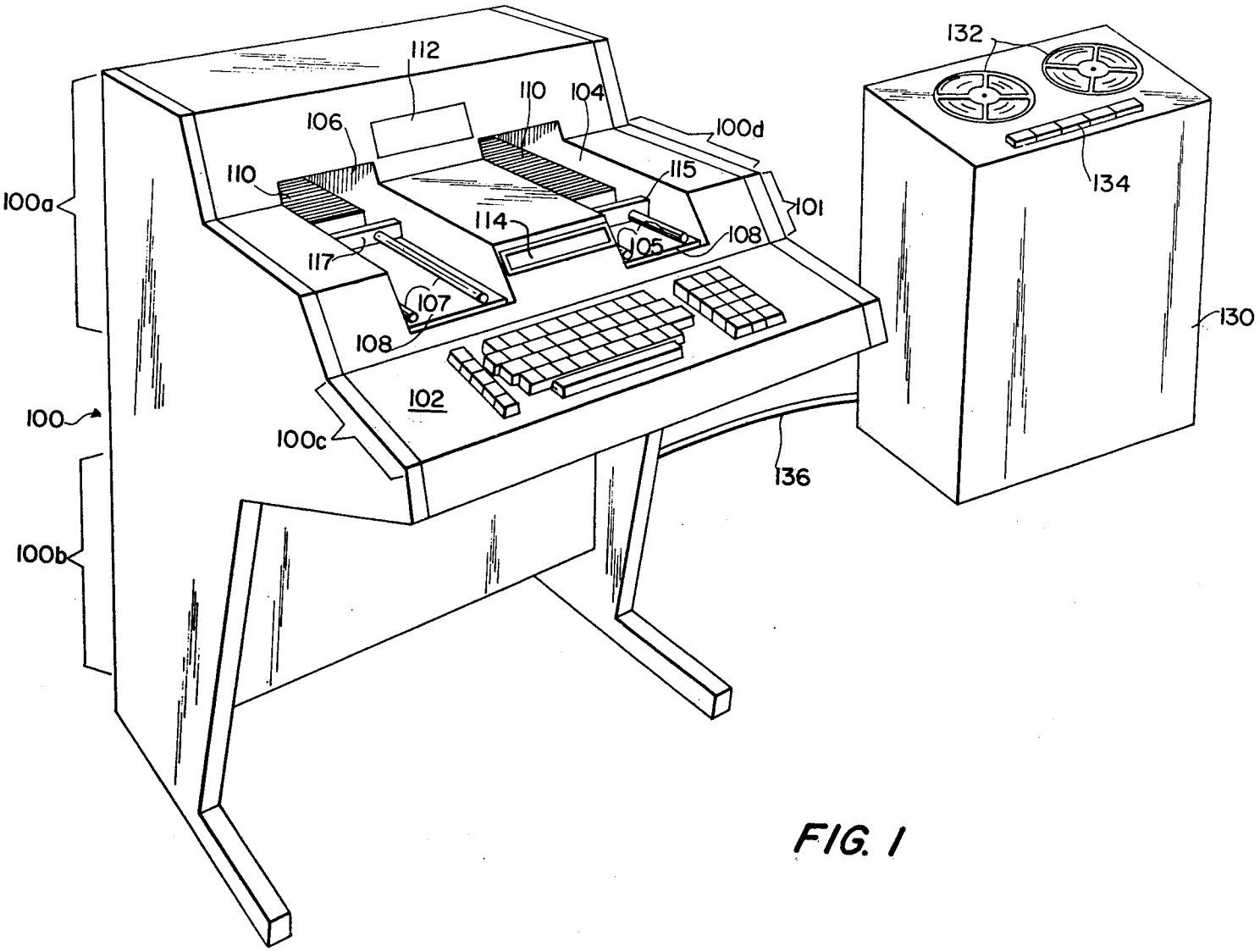
FIG. 1 is a perspective view of the embossing system of the invention, shown partially in schematic and broken-away form.

This invention relates to an automatic embossing system and, more particularly, to such a system employing a rotatable embossing wheel having mounted about the periphery thereof a plurality of associated punch and die elements for embossing characters into a suitable medium, such as a credit card. This arrangement provides for a relatively low cost and compact embossing system. The wheel is rotated to a given position, and then an individual card to be embossed is transported relatively to the wheel, to be embossed by the thus selected punch and die pair.

The card transport mechanism includes a carriage for withdrawing a card from a hopper which may automatically pick and thereby feed cards to an appropriate position for engagement by the carriage. The carriage transports the cards to the vicinity of the embossing wheel and particularly to position the card for embossing at each location thereof, in succession, for being embossed by the currently selected punch and die pair. The carriage also transports the card, when embossing is completed, from the vicinity of the wheel to an output stacker.

To achieve maximum efficiency and speed in the system card transport and embossing operations, the system design provides that the lowest inertia elements are moved the greatest in extent and most frequently and the highest inertia elements, the least in extent and frequency.

Accordingly, each character corresponding to a punch and die pair of the embossing wheel is designated by an address. Data representing the characters to be embossed is supplied to the system either by keyboard input, automatic magnetic tape reading, or the like. The character data for embossing is processed to include three control numbers for each character, the first corresponding to the address of the type wheel for that character and the second and third numbers corresponding to vertical and horizontal displacements of the card relatively to a reference position of the card relative to the embossing wheel. This data is sorted in accordance with the ascending order of embossing wheel addresses and correspondingly assigned first control numbers for common character positions of the wheel, for all such positions in succession. The coding of common characters further includes coding of the one of two or more lines afforded on a card thereby to establish the third control number and by the positions of each character in each line, thereby to establish the second control number. The data thus sorted is stored in a random access memory (RAM).

Certain basic operating parameters of the system as well are established as digital number values stored in a read only memory (ROM). For example, the distance from the input hopper to the embossing wheel and from the latter to an output hopper are defined individually by digital numbers and conveniently by 16 bit words. Hence, each position of the card in its transport to the embossing wheel and from the embossing wheel to the output hopper can be precisely defined by a corresponding 16 bit word. Likewise, the vertical positions of the card transport mechanism, both relatively to the embossing lines on a card as positioned at the embossing wheel for each of successive, vertically displaced lines on the card and from a nominal card position relatively to the input hopper and that relatively to the output stacker, for engaging a new card and discharging an embossed card, respectively, can be stored as predetermined values.

The actuating mechanism for the punch and die pairs includes respectively associated bail arms which are driven in continuous oscillatory motion by a linkage mechanism associated with a continuously rotating embossing shaft, each rotation of that shaft establishing a basic embossing cycle and hence basic timing rate of the system. A suitable photocell detector provides an output for each rotation thereby to produce a basic timing clock of the system.

An interposer system is selectively actuable, when the embossing wheel is rotated to a selected address for embossing a selected character onto a card, to be interposed between a driving element associated with each of the bail arms, and the rearward or outer end of the respective punch and die thereby to cause the latter to be mechanically moved into the embossing position. At the completion of the embossing cycle, retractor means withdraw the punch and die elements from the embossing position to a rest position, these elements as well being normally retained in the rest position by resilient biasing means within the embossing wheel.

In operation, when data for a given card has been introduced into the system and sorted and thereupon stored in the sorted form, a central processing system including a microprocessor CPU then activates the servo systems, with reference to the data in the ROM and the RAM, to cause the carriage to engage a card and move it to the reference position from which the distance is computed to the first embossing location on the card for the first embossing address of the embossing wheel. The servo systems are controlled to produce movement of the card with a velocity related to the distance of motion required. When the card is properly positioned at a first embossing location, at the next embossing cycle, or interval, the embossing is performed. At the conclusion of that embossing interval, the servo systems again are enabled for moving the card to the next location. In this manner, each character, for the corresponding address to which the embossing wheel has been rotated, is embossed in each successive position on a given line, for each line in succession, for each successive character address of the embossing wheel. Upon conclusion of embossing of the last character at its last position on the card, the card is returned to its reference position, that distance being determined by a sum total of the displacements of the card from the reference position to the last position for the character currently being embossed. When the card is returned to its reference position, the central processing system then drives the servos in accordance with the stored values for transport of the card from the reference position to the output hopper.

The output hopper includes a novel deflection system whereby, if an error occurs, the card received therein is deflected to a reject portion whereas if the card is acceptable or good, it is deflected to an "accept" portion of the output hopper.

Additional operations may be performed on a card by corresponding modules afforded in the system, such as magnetic encoding of the conventional mag stripe typically found on the rear of a card, as well as embossing with optical character reader (OCR) characters and topping of all such embossed characters.

DETAILED DESCRIPTION OF PREFERRED EMBODIMENT

FIG. 1 is a perspective view of the embossing system 100 of the invention, shown in an illustrative enclosure which houses the embossing mechanism generally within the upper portion 100*a*, the electronics for the control of the embossing operations generally within the lower portion 100*b*, a keyboard 102 in a forward extension 100*c* of the cabinet, and an input card hopper 104 and an output stacker 106 mounted within the horizontally and forwardly extending portion 100*d*. As will later become clear, a horizontal bed 108 is exposed within the hopper 104 and the stacker 106 to receive thereon cards 110, the cards 110 being shown in the input hopper 104 prior to embossing operations and in the output stacker 106 subsequent to embossing operations. The input hopper 104 includes a pair of guide rails 105 and an associated slide member 115 which is spring loaded to urge the stack of cards 110 into the feed hopper 104. In similar fashion, the output stacker 106 includes a pair of guide rails 107 and a spring loaded slide element 117 received thereon for resiliently receiving the cards subsequent to the embossing operation and maintaining same in a convenient upright stack within the output stacker 106.

A transparent shield 112 covers an opening to permit visually observing the embossing operations occurring within the upper portion 100*a* by the embossing apparatus contained therein.

Also provided within the section 100*d* on the inclined vertical front surface 101*d* is a visual display panel 114 for displaying certain coded symbols indicative of control functions and other conditions of the system as well as for displaying the characters selected by actuation of the appropriate keys of the keyboard 102, thereby to confirm accuracy of the information supplied for embossing on a given card.

A tape transport system 130 may be provided as illustrated in FIG. 1 as an independent system or if preferred may be incorporated into the basic housing 100. In the embodiment of FIG. 1, the separate transport system 130 includes illustratively the magnetic tape reels 132 and control buttons 134 serving to control the tape transport unit 130. The unit 130 provides both for recording data entered by the keyboard and for automatically supplying prerecorded data relating to information to be embossed on credit cards by the embossing system 100. A suitable conductor cable 136 joins the units 100 and 130 to permit the necessary communication therebetween.

Figure 2A:
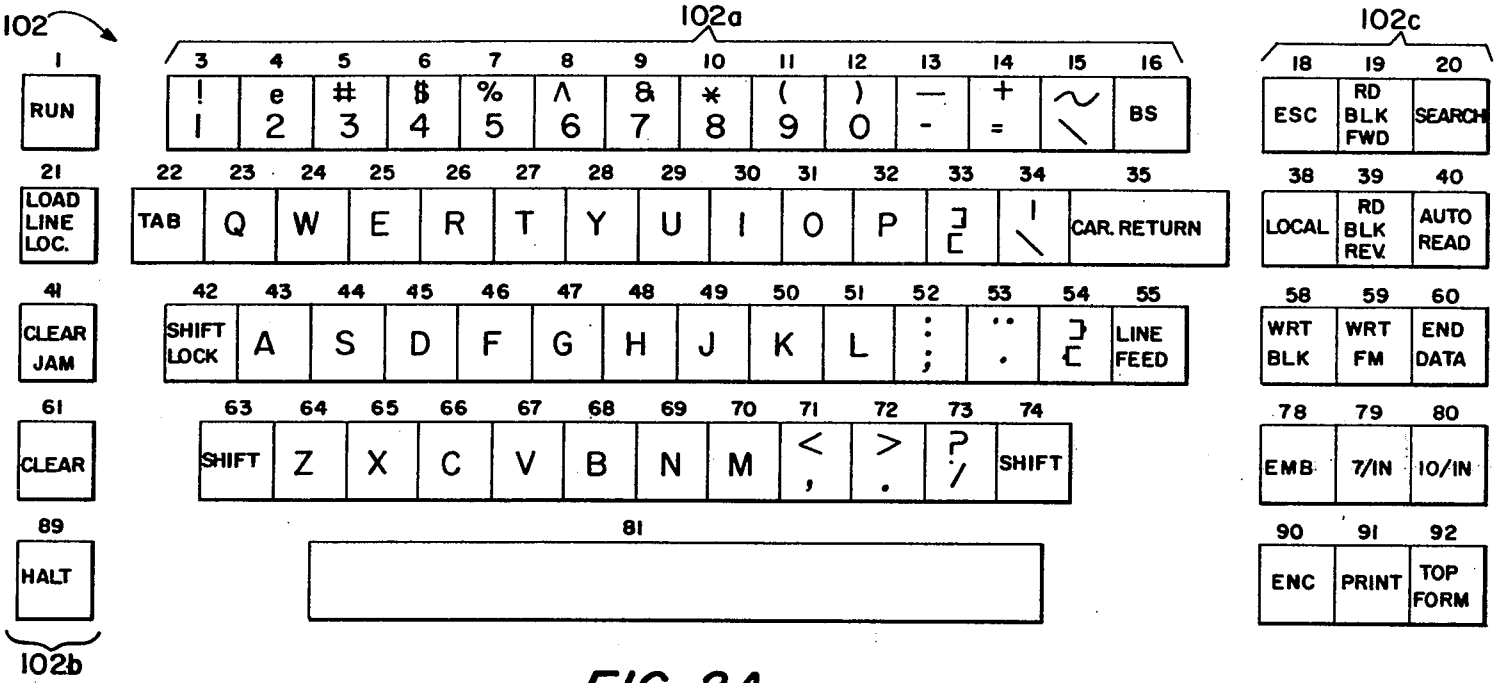
FIG. 2A is a detailed view of a keyboard of the system of FIG. 1.

FIG. 2A is a more detailed view of the keyboard 102. The central portion 102*a* of the keyboard 102 includes individually actuable keys for selecting any of various alphanumeric and other symbols which the system is capable of embossing on a card, plus certain conventional keyboard control functions such as are provided on a conventional typewriter. The control keys 102*b* to the left of the keyboard 102*a* provide certain basic controls of the embossing system itself.

The three vertically disposed rows of keys 102*c* to the right of the keyboard 102*a* variously provide for control of the magnetic tape transport system 130 and for generating internal control codes for the embossing system 100 used during embossing operations. More specifically, the keys numbered 19, 20 38–40, 58 and 59 comprise magnetic tape controls whereas the remaining keys, numbered 18, 60, 78–80 and 90–92 are actuated during entry of data on the keyboard 102*a* to provide various codes which are stored in association with the data in the operating memory of the electronics of the embossing system 100, thereby to control subsequent embossing operations utilizing that stored data. Further details on the specific functions of these various control keys are provided hereinafter.

Figure 2B:
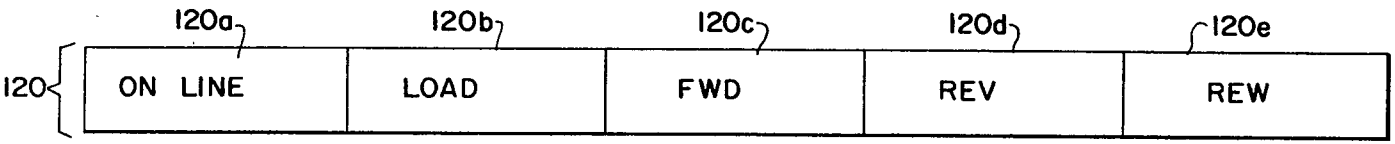
FIG. 2B illustrates in detail control buttons associated with a magnetic tape transport unit illustrated in FIG. 1.

FIG. 2B illustrates in more detail the control buttons 120 associated with the magnetic tape transport unit 130 itself. The ON LINE key 120*a* must be actuated to place the tape transport unit 130 in the ON LINE mode; the keyboard magnetic tape controls mentioned hereinabove are enabled only when the tape transport unit 130 is in the ON LINE mode. Further, in the ON LINE mode, the other transport controls 120*b*, 120*c*, 120*d*, and 120*e* are disabled. Those latter controls more specifically are the conventional tape controls for LOAD (120*b*), FWD (FORWARD—120*c*) REV (REVERSE—120*d*) and REW (REWIND—120*e*).

As will later be detailed, the embossing system of the invention may operate either on keyboard-input information for embossing of cards or, more typically and in the instance of production of large numbers of cards, will utilize pre-stored and pre-coded data on the magnetic tape on reels 132 read out by the tape transport unit 130 for automated embossing and encoding, along with other functions to be described, of a large number of cards, in succession.

Aside from the basic housing for the embossing system, as shown in FIG. 1, and the tape transport system 130, the major sub-systems or sub-assemblies of the embossing system of the invention include the embossing mechanism for actually embossing characters in the plastic cards 110, the input hopper 104 and output stacker 106, the card transport mechanism, and the electronic data processing and control system. Each of these basic subsystems is discussed in detail hereinafter.

Figure 3:
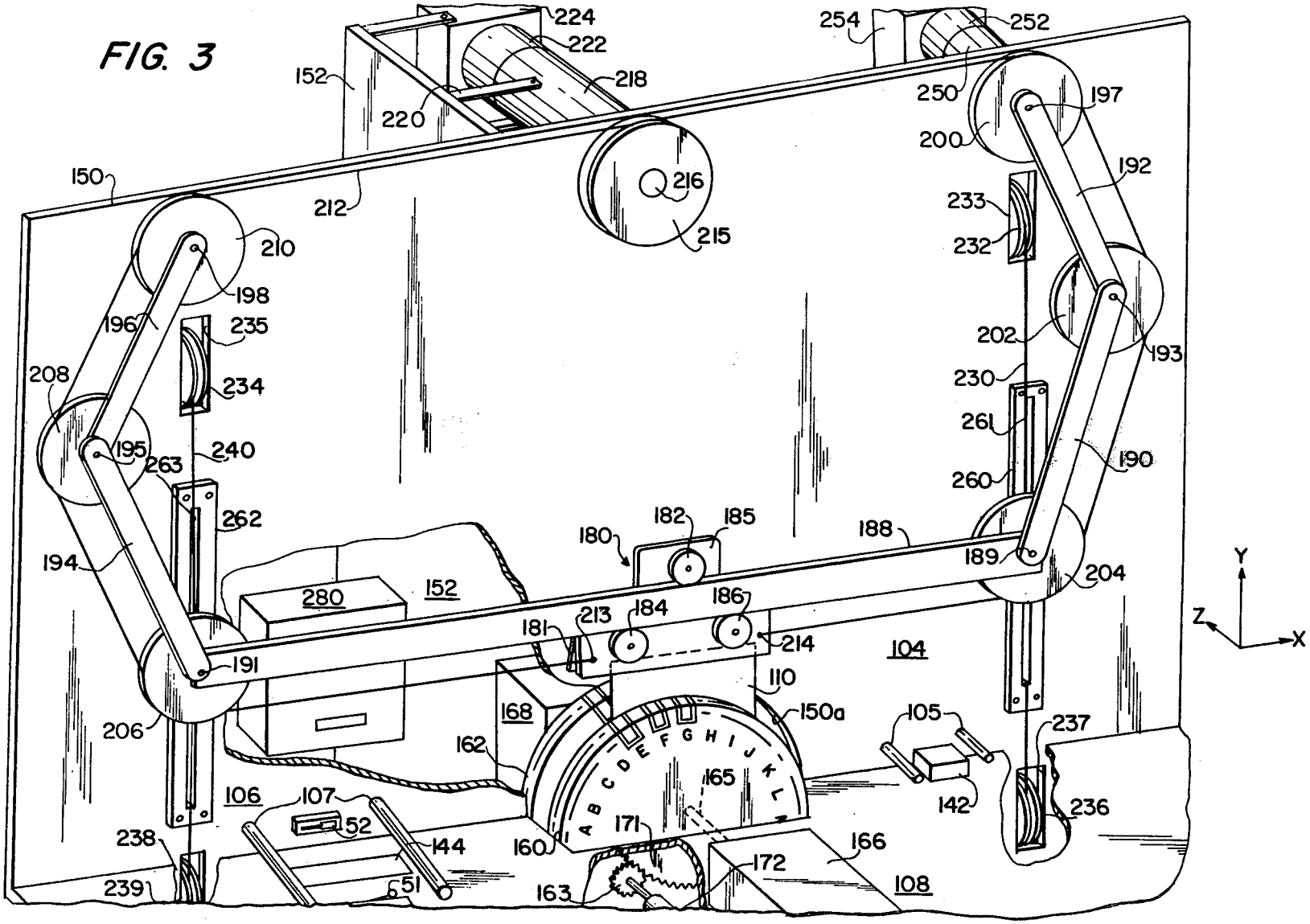
FIG. 3 is a perspective view, partially schematic and partially broken-away, of various of the subsystems of the embossing system of the invention of FIG. 1.
Figure 4:
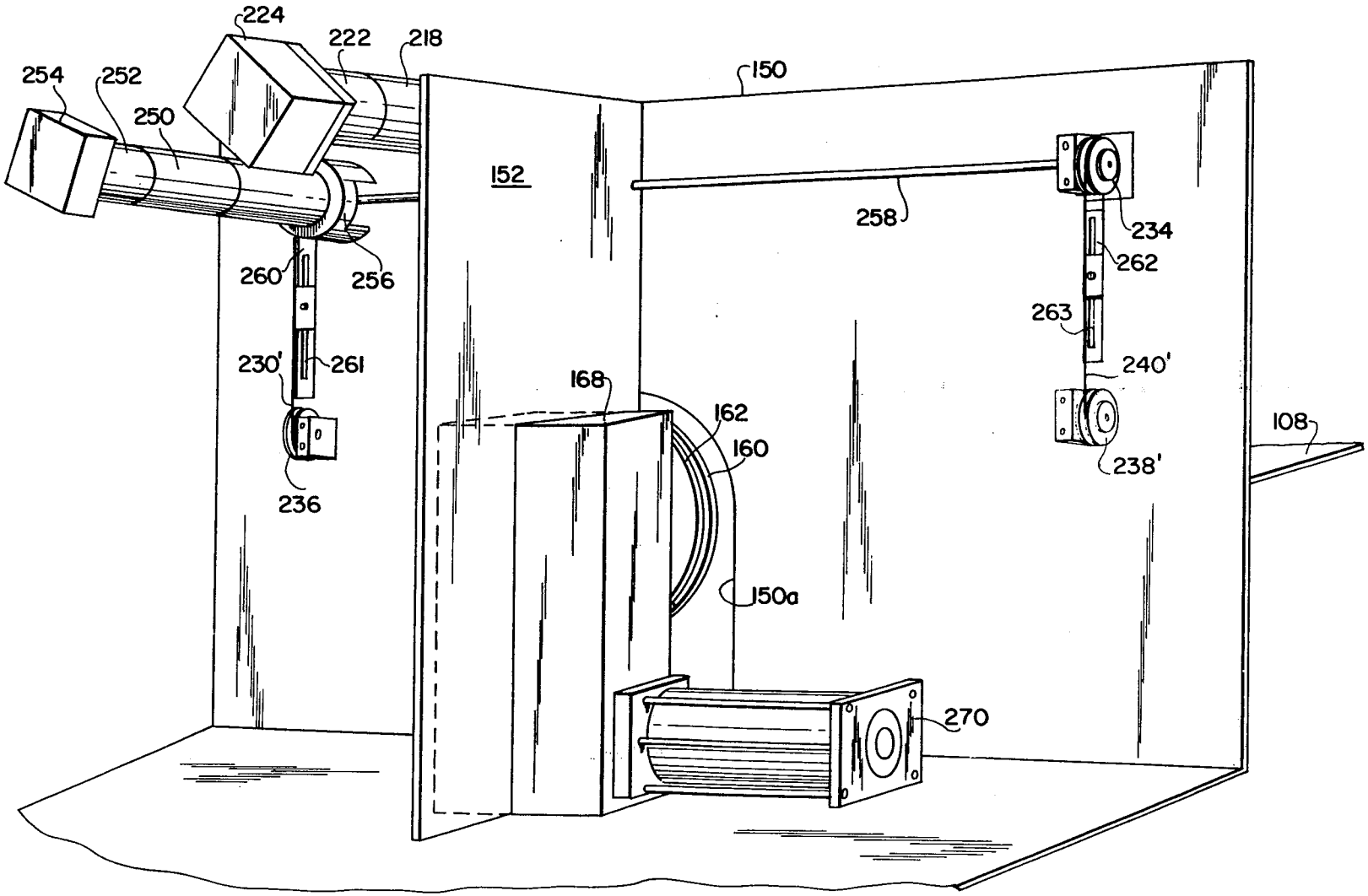
FIG. 4 is a rear perspective view of the subsystems of FIG. 3.

FIG. 3 is a perspective view, partially schematic and partially broken away, of various of the subsystems of the embossing system of the invention. FIG. 4 is a rear perspective view of the sub-assemblies as shown in FIG. 3 wherein like parts are numbered by identical numerals as in FIG. 3.

With concurrent reference to FIGS. 1, 3 and 4, the input hopper 104 and output stacker 106 are now identified in association with broken-away segments of the guide rals 105 and 107, respectively. Actuating mechanisms associated with the input hopper 104 and output stacker 106 are schematically indicated by blocks 142 and 144, respectively, in FIG. 3 and are discussed in detail hereinafter. The output stacker 106 includes front and rear portions for receiving, respectively, accepted and rejected cards displaced therein by the mechanism 144 and having respectively associated therewith a switch 51 engagable by slide element 117 and a switch 52 engagable by rejected cards, each, when actuated, indicating a card full condition of its respective portion. The bed or base plate 108 seen in FIG. 1 as forming the base or horizontal support surface of the input hopper 104 and the output stacker 106 may preferably constitute a continuous horizontal plate 108 as seen in FIG. 3 in broken-away fashion.

The base plate 108 is affixed to a main vertical support plate 150 by suitable brackets (not shown); extending to the rear of the main support plate 150 is a secondary vertical support plate 152 likewise joined to the plate 150 by suitable brackets (not shown). The main support plate 150 as well is broken away to facilitate illustration of various elements as now described.

The embossing mechanism or subsystem includes a pair of type wheels 160 and 162 respectively including matching punch and die pairs such as for the alpha characters illustrated schematically for illustrative purposes on the two wheels 160 and 162. Specifically, as shown for the alpha characters E and F, the punch and die pairs are positioned in corresponding slots about the circumferential periphery of the wheels, the two wheels being integrally joined by a common hub (not shown in FIG. 3) and mounted for rotation on an axle 165 to position the desired punch and die pair, for example, for the letter G, at the embossing station. When so positioned, and when the card as well is moved to locate the character embossing position thereof which is to receive the letter G, at the station, the punch and die pairs are actuated into engagement, with the card 110 therebetween, by the actuating mechanisms 166 and 168. These mechanisms 166 and 168 are illustrated schematically and in an exploded manner and thus removed from the wheels 160 and 162 to facilitate the illustration of the latter in FIG. 3. As later detailed, the actuating mechanisms are in close juxtaposition with the wheels for purposes of engaging the selected punch and die pair and actuating same to emboss the desired character in the card at the appropriate card location. A gear 171 is affixed to the wheels 160 and 162 and is engaged by a spur gear 163 mounted on shaft 164 of a DC permanent magnet servo motor 172. The motor 172 has associated therewith (see FIG. 13) a DC tachometer 174 and an optical encoder 176. The tachometer 174 provides velocity information for feed back loops in the servo control system while the encoder 176 provides position feed back information. The secondary vertical support plate 152 as well is broken away in FIG. 3 to permit illustrating the rear actuating mechanism 168 for the embossing subsystem.

The card transport subsystem includes as a prinicipal component a carriage 180 supported by rollers 182, 184 and 186 on a rail 188. The carriage 180 includes a clamping structure schematically shown at 180 in FIG. 3 for engaging the card 110 and disposing same between the punch and die pairs for embossing same.

The rail 188 is part of a horizontal card transport mechanism which further includes a pair of control arm linkages 190, 192 194 and 196, the linkages being pivotally interconnected as shown at 193 and 195, respectively. Guide rail 188 is pivotally connected to the control arms linkage 190 and 194 as shown at 189 and 191, respectively, and the upper linkages 192 and 196 are mounted to fixed pivots 197 and 198 secured to the vertical support plate 150. Pulleys 200, 202, 204, 206, 208 and 210 are mounted for rotation on the associated pivots and a flexible steel cable 212 is received about the peripheries of the pulleys and wound around a drum 215. The flexible steel cable 212 is joined at its opposite ends to the carriage 180 at connections 213 and 214. The drum 215 is mounted on an axle 216 driven by a horizontal transport DC servo motor 218, the latter secured to the support plate 152 by an appropriate bracket 220. Associated with the motor 218 is a tachometer 222 and an optical encoder 224 for providing horizontal velocity feed back and position feed back.

The vertical card transport mechanism is best appreciated by concurrent reference to FIGS. 3 and 4. Each end of the rail 188 is connected to associated flexible steel cables 230 and 240 which pass over driving pulleys 232 and 234 exposed through suitable apertures 233 and 235, respectively in the vertical plate 150 and over idler pulleys 236 and 238 which likewise project throught respective apertures 237 and 239 in the vertical plate 150.

As better seen in FIG. 4, the driving and idler pulleys for the cables 230 and 240 are mounted by appropriate brackets to the vertical plate 150. The driving pulley 232 actually is hidden from view in FIG. 4 by the vertical transport DC servo motor 250 which, again, has associated therewith a DC tachometer and an optical encoder 252 and 254 for providing vertical velocity and position feed back output signals. The motor 250 operates through a suitable gearing arrangement 256 to drive the driving pulley 232 and further operates through cross shaft 258 for driving the pulley 234 in unison with the pulley 232.

Referring again to FIG. 3, there are provided guides 260 and 262 having respective openings 261 and 263 therein for receiving a sliding connection joined to the pivot points 189 and 191, respectively, at the opposite ends of the guide rail 188.

With reference to the x, y, z coordinate directions in FIG. 3, the guide 260 constrains movement of the pivot point 189 and thus of the right-hand end of the guide rail 188 (i.e., as seen in FIG. 3) from movement in either the x or the z directions while permitting free movement in the y direction. The guide element 262, on the other hand, restrains movement of the pivot point 191 and thus of the left-hand end of guide rail 188 only in the z direction and thus does not prevent any motion in either the x or y directions. This is to insure that the guide rail 188 does not "bind" in its vertical movement under control of the vertical transport mechanism.

The vertical transport mechanism, accordingly, controls the vertical position of the guide ril 188 by raising or lowering same through the cables 230 and 240 attached to the pivot points 189 and 191, as permitted only in the y direction by the guide 260. The geometry of the guide rail 188/control arm linkage (i.e., the elements 190, 192 and 194, 196) in association with the related pivot points is such that the guide rail 188 can move vertically under control of the vertical transport mechanism without changing the length of the horizontal transport cable 212. Thus, the horizontal and vertical movements of the carriage 180 are independent.

Referring further to FIG. 4, there is additionally shown an AC motor 270 which operates the embossing mechanisms 168 and 166 (FIG. 3) and a motor 272 for the input hopper feed mechanism.

Finally, FIG. 3 illustrates certain optional equipment which may be provided although same is not shown in FIG. 4. Particularly, a magnetic encoding module 280 may be suitably mounted on the plate 150, with a recording head extending through an aperture therein to magnetically encode the conventional mag stripe as afforded on the reverse side of standard credit cards in commercial use today. The module 280 may alternatively be positioned near the input hopper 104 to permit magnetic encoding of the mag stripe prior to the embossing operation. A further component not illustrated in FIG. 3 may comprise a so-called "topper" which in conventional fashion applies a dark inked topping, typically by heat and pressure transfer of ink from a foil onto the embossed characters subsequently, of course, to the embossing operation. Such a topper mechanism would be positioned in the same general vicinity as the magnetic encoding module 280, if one is provided. In that instance, assuming that the embossed characters project away from the vertical plate 150 (i.e., the die elements would be provided in the wheel 160), as is typically the case, then the topper would be positioned in front of the path of travel of card 110 during horizontal transport by the carriage 180 to provide the desired topping on the raised characters, prior to depositing the card in the output stacker 106.

DETAILED DISCUSSION OF SUBASSEMBLIES OF EMBOSSING SYSTEM

Input Hopper 104 and Feed Mechanism 142

Figure 5A:
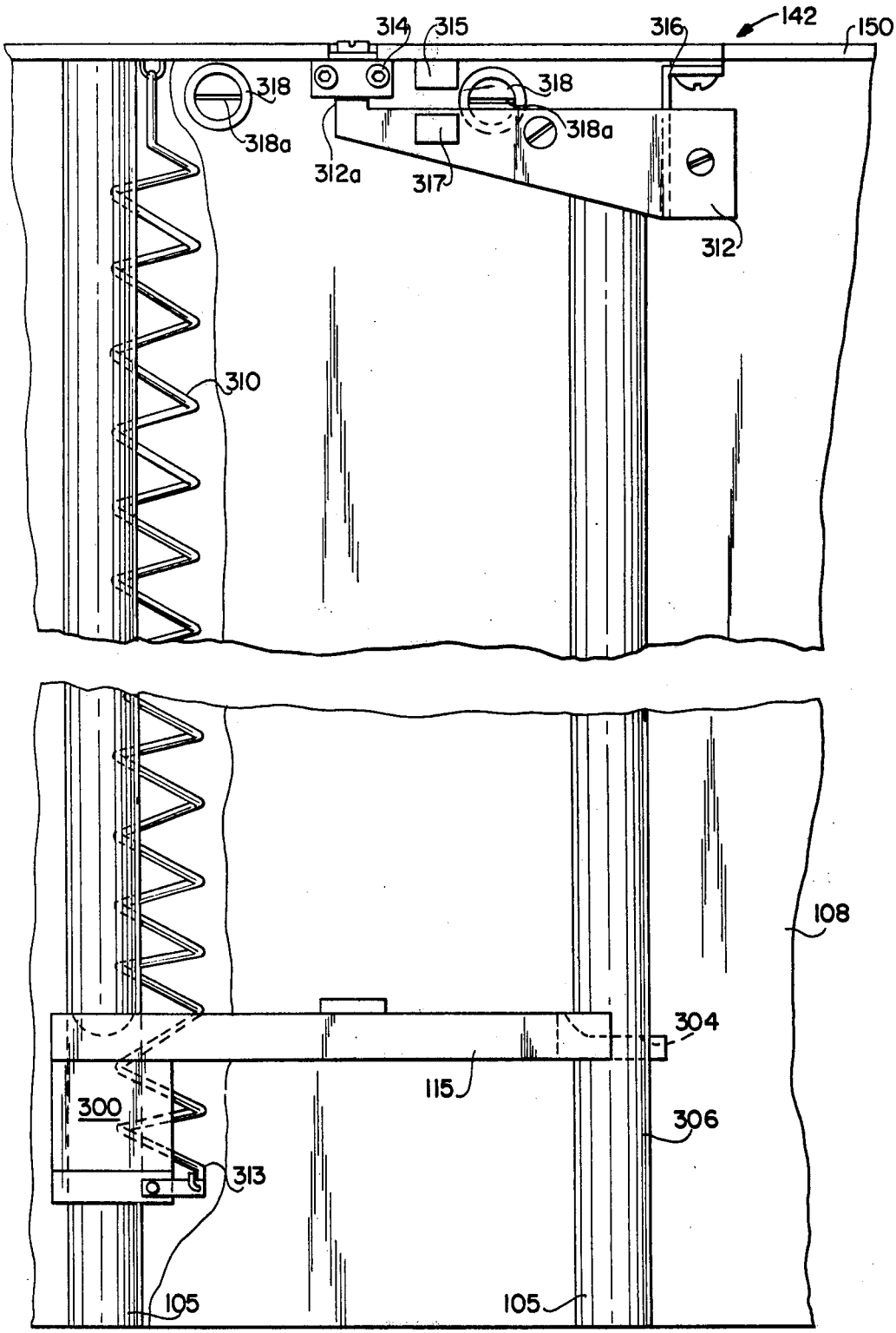
FIGS. 5A, 5B and 5C are top plan, front elevation and side elevation views of an input hopper of FIG. 1 for receiving cards to be embossed by the system.
Figure 5B:
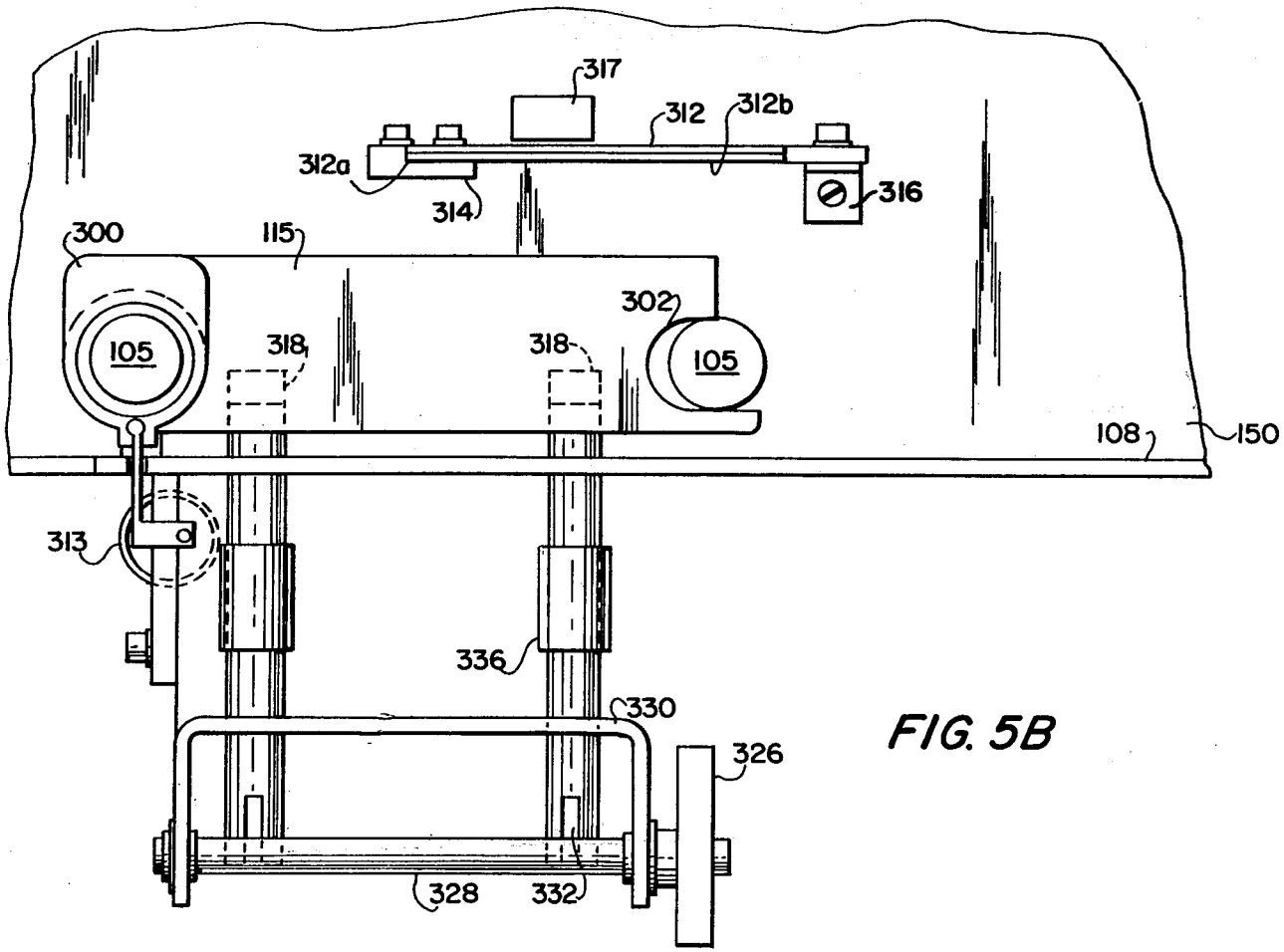
Figure 5C:
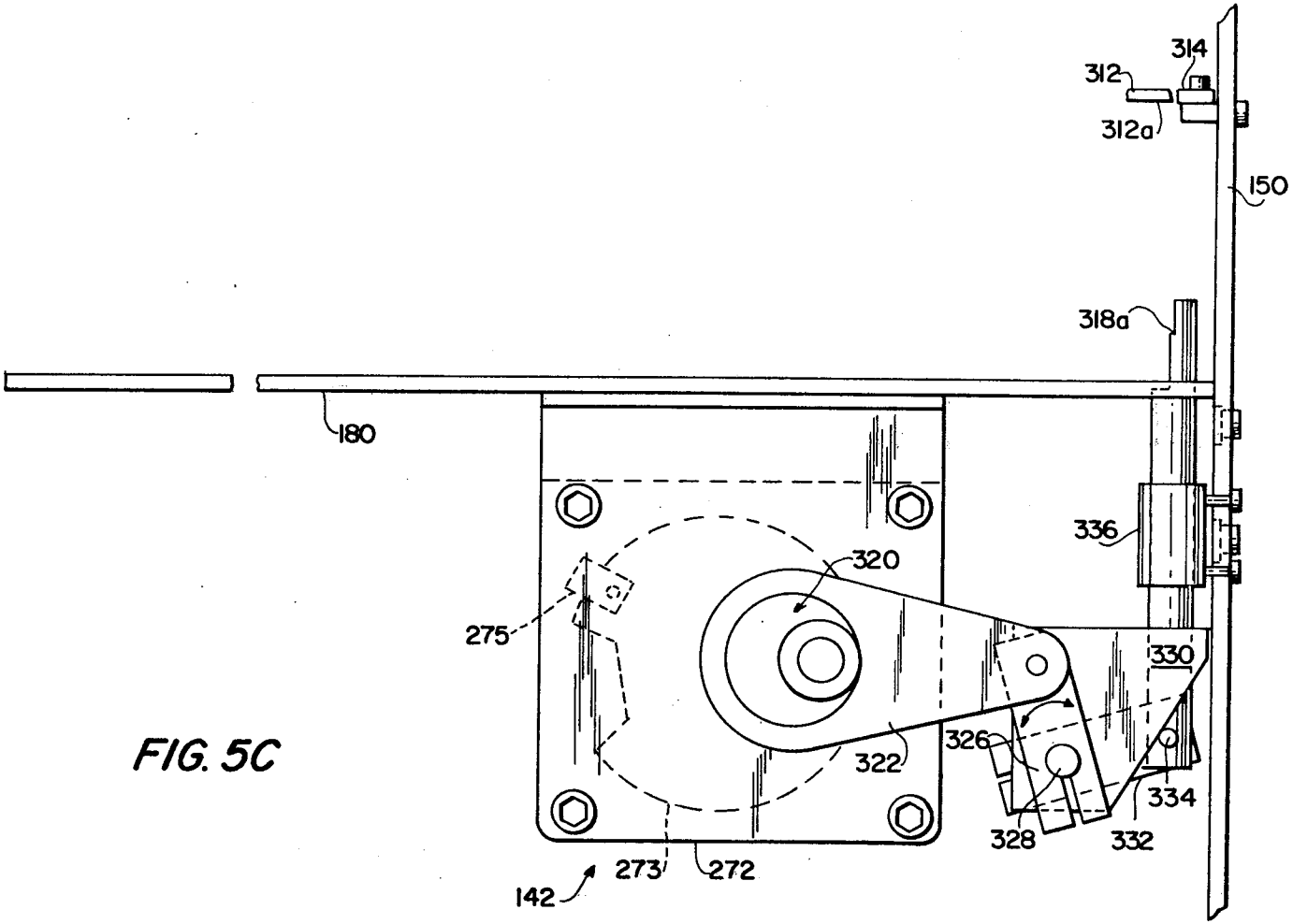

The input hopper 104 and the feed mechanism 142 for feeding individual cards 110 into position for engagement by the carriage 180 is shown in more detail in FIGS. 5A, 5B and 5C, respectively showing top plan, front elevation, and side elevation views thereof. Elements in FIGS. 5A–5C corresponding to those of the preceding figures are shown by identical numerals. In these views, the guide rail has been removed for clarity of illustration of the feed mechanism 142.

With concurrent reference to FIGS. 5A–5C, slide element 115 includes a first bearing 300 received on the associated rod 105 in close engagement so as to prevent movement radially of the rod 105 but to permit free sliding movement axially therealong and, at its opposite end, includes an enlarged recess 302 for sliding engagement on the other rod 105, the enlargement avoiding any binding of the sliding plate 115 thereon. A spring 310 resiliently urges the plate 115 toward the support wall 150 thereby to advance cards received between the guide rails 105 to the feed mechanism 142. A plate 312 is beveled on its lower surface (not seen in FIG. 5A; shown at **312*b* in FIG. 5B) to urge the cards downwardly against the base plate 108 as they approach the feed position and moreover includes an extension 312*a* associated with an adjustable mechanism 314 for defining therebetween a feed throat having a thickness just slightly in excess of that of the card. The plate 312 is suitably connected by bracket 316 to the support 150**.

A pair of pickers 318 are mounted for vertical, reciprocating movement. Each includes a conventional picker edge **318*a* (one of which is better seen in FIG. 5C) to engage the bottom edge of an individual card and advance same through the throat defined between the elements 312*a* and 314 into a raised position to be engaged by the carriage 180 when positioned over the input hopper. Lamp 315 and photocell 317 are positioned to detect passage of a card therebetween to indicate the feeding of a card from the input hopper 104 by mechanism 142** and subsequent removal therefrom by the card transport mechanism.

The pickers 318 are driven by motor 272 which drives an eccentric 320 pivotally connected to a link 322 and a drive arm link 326 secured to an axle 328, rotatably mounted at a fixed pivot point on the mounting bracket 330 secured to the support wall 150. A drive arm 332 is likewise mounted on axle 328 and pivotally connected at 334 to the pickers 318 for driving same in common in the vertical reciprocating movement. Pickers 318 extend in sliding engagement through brackets 336 mounted on wall 150, and through plate 108. Motor 272 drives a timing disc 273 (shown in hidden view) having a slot therein detected in each revolution by a photocell detector 275.

Figure 6A:
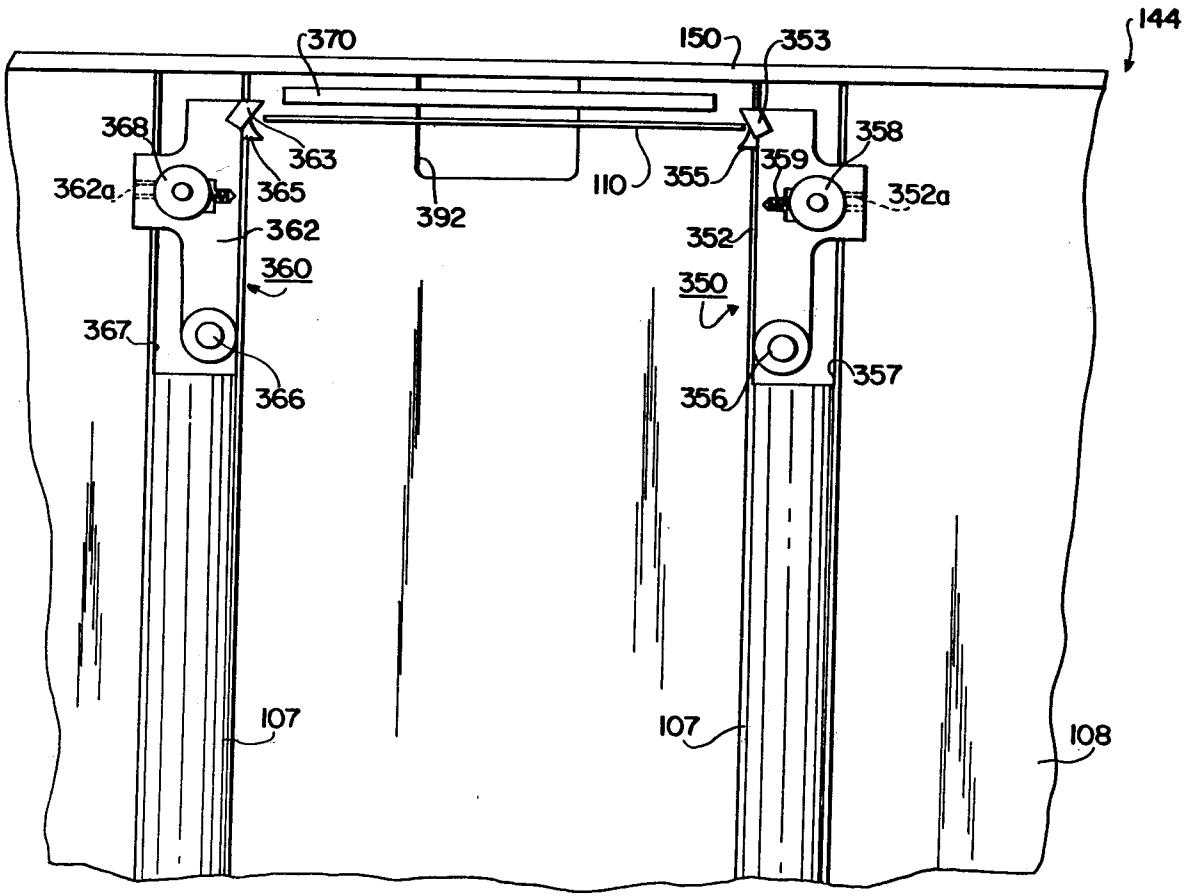
FIGS. 6A and 6B are top plan and side elevation views of an output stacker and associated actuating mechanism of the system of FIGS. 1 and 3 hereof.
Figure 6B:
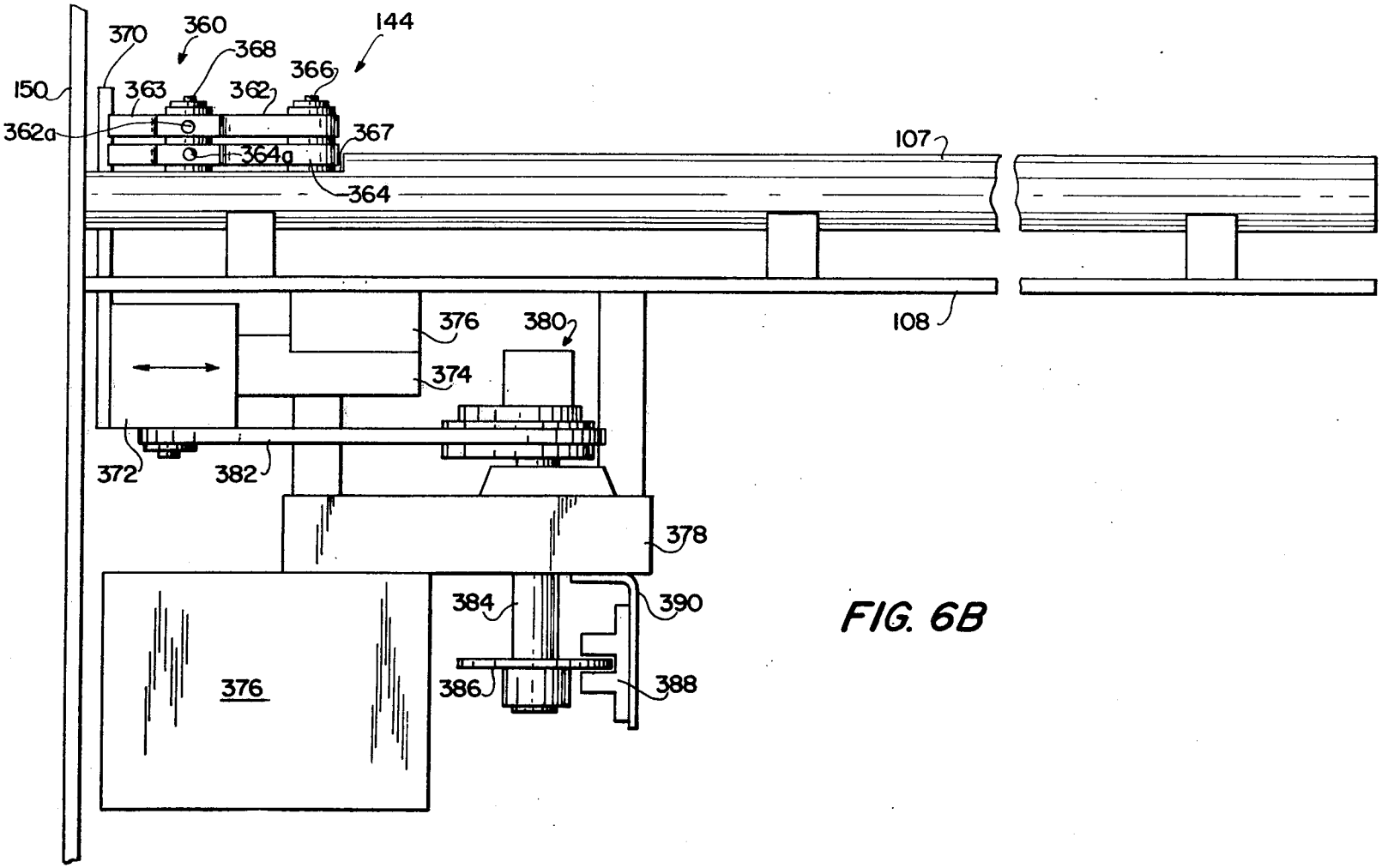

Output Stacker 106 and Actuating Mechanism 144: FIGS. 6A and 6B

FIGS. 6A and 6B comprise top plan and side elevation views of the output stacker 106 and its actuating mechanism 144, elements identical to those of preceding figures being shown by identical numerals. Again, the guide rail 188 is removed to permit clarity of illustration in each of FIGS. 6A and 6B.

With concurrent reference to FIGS. 6A and 6B, the output stacker mechanism 144 includes a pair of movable detent mechanisms 350 and 360 which are of substantially similar construction. As best seen in FIG. 6B, the mechanism 360 includes an upper portion 362 carrying the angular extension 363 (FIG. 6A) and a lower portion 364 carrying the angular extension 365 (FIG. 6A). The extensions 353, 355 and 363, 365 are seen in FIG. 6A to define vertical engaging grooves for engaging the left-hand and right-hand edges respectively of the card 110 as seen in FIG. 6A (i.e., the leading and trailing edges, respectively, of the card 110 with regard to the motion of travel of the carriage 180 in FIG. 3).

Each of the mechanisms 350 and 360 is pivotally mounted to one of the rails 107 by pivotal mounts 356 and 366, respectively, the rails being suitably machined to define a flat mounting surface therefor, as shown at 357 and 367, respectively. A stop 358 and 368 is associated with each mechanism for controlling the extent of pivoting motion of the associated detent mechanisms, as adjusted by set screws in each portion thereof, as shown at 352*a* and 362*a*. A compression spring, as seen at 359 in the partially broken-away view of the mechanism 350, resiliently urges the mechanisms into engagement with a card.

There further is provided a paddle 370 which extends through an opening 392 in the base plate 108, the lower extension thereof, i.e., that portion below the base plate 108 being secured to a block structure 372 having an extension 374 received in a guide 376 to permit reciprocating action thereof in a direction perpendicular to the support wall 150 and parallel therefore to the base plate 108. Motor 376 drives a gear box 378 and in turn an eccentric 380 which operates through crank arm 382 and block 372 to move the paddle in one or the other displaced positions thereof in the aforesaid reciprocating movement. A shaft 384 driven by the gear box and in turn driving the eccentric 380 has mounted on the lower end thereof as seen in FIG. 6B a notched photocell disc 386, the periphery of which is received in a photocell sensor 388 mounted to the gear box 378 conveniently by the bracket 390. The output of the photocell provides a start/stop (high/low) shaft position indication thereby indicating the rotation of the shaft and hence the movement of the paddle 370 through the interconnecting train as above described.

The actuating mechanism 144 of the output stacker 106 provides an automatic and convenient technique for separating rejected cards from properly processed cards in the output stacker 106. Particularly, rejected cards are displaced to the position between the paddle 370 and the support wall 150 whereas properly processed cards are displaced into the portion of the stacker extending outwardly from the paddle 370.

In operation, the detent mechanisms 350 and 360 are normally in the position indicated. Where no error condition is detected, the paddle 370 is displaced to the position shown in FIG. 6A. A properly processed card then, upon release from the carriage 180 when positioned over the output stacker 106, falls by gravity into the position shown in FIG. 6A whereby the opposite edges are received between the extension elements 353, 355 and 363, 365. The motor 376 then is energized to move the paddle 370 in a direction away from the support wall 150 so as to urge the card beyond the engagement by the spring detent mechanism into the output stacker. The spring loaded detent mechanisms 350 and 360 resiliently open to permit the card to progress in that direction and then snap closed to the position shown, thereby to retain good cards in the forward portion of the stacker. Conversely, if an error condition exists, the paddle 370 is initially moved to a forward position (i.e., displaced from the support wall 150) and, when a card is received in the detent mechanism, the paddle then is energized to move the card toward the support wall 150, the elements 350 and 360 resiliently opening to permit the card to progress in that direction and then closing, thereby retaining the defective cards in the space at the rear, hereinafter termed the reject stacker. The timing controls for these mechanisms are discussed hereinafter.

Card Carriage 180 and Horizontal Transport Mechanism: FIGS. 7A–7D

Figure 7A:
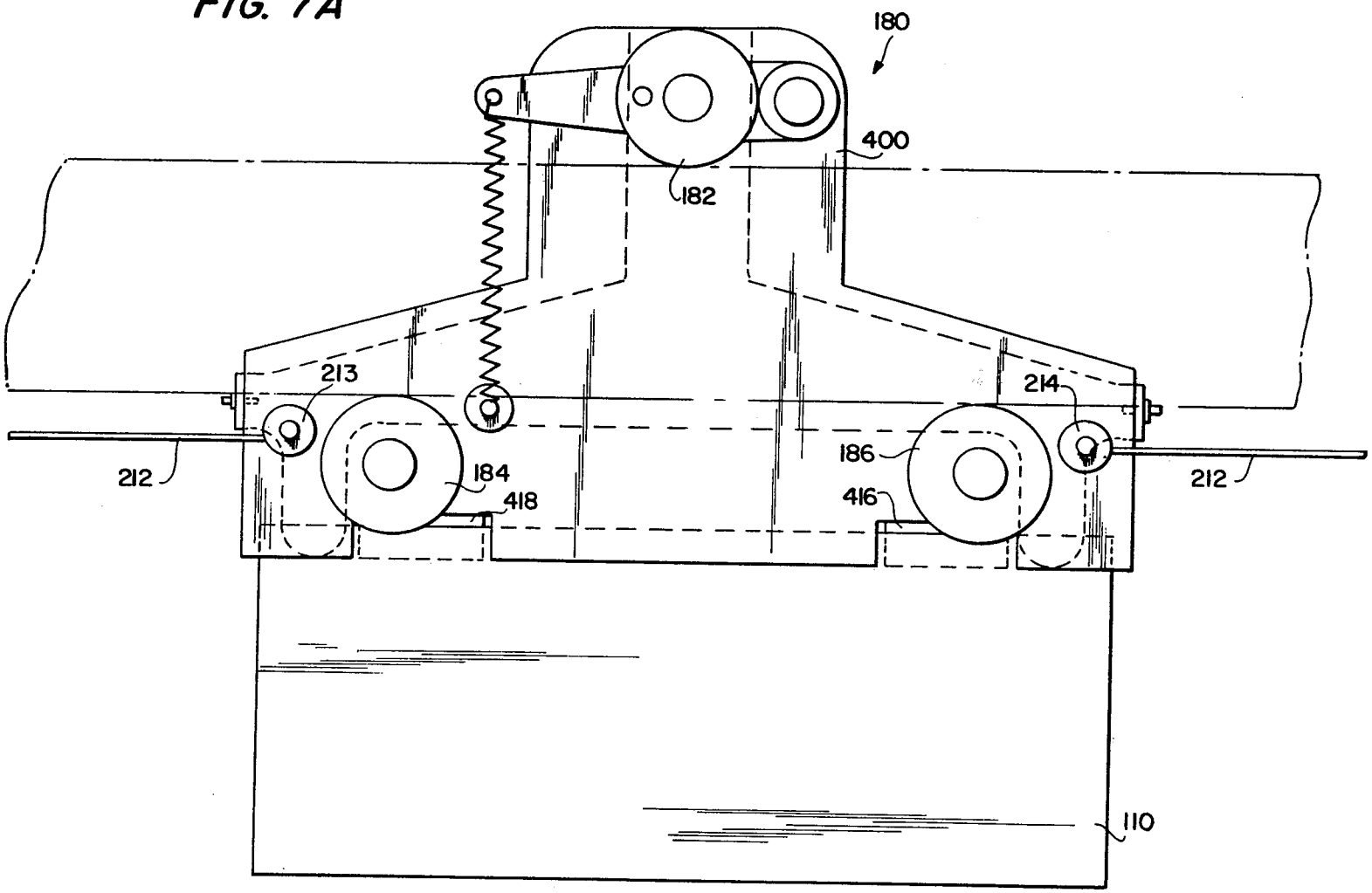
FIGS. 7A, 7B, 7C and 7D are front elevation, rear elevation, side elevation, and top plan views, respectively, of a card carriage and card transport mechanism.
Figure 7B:
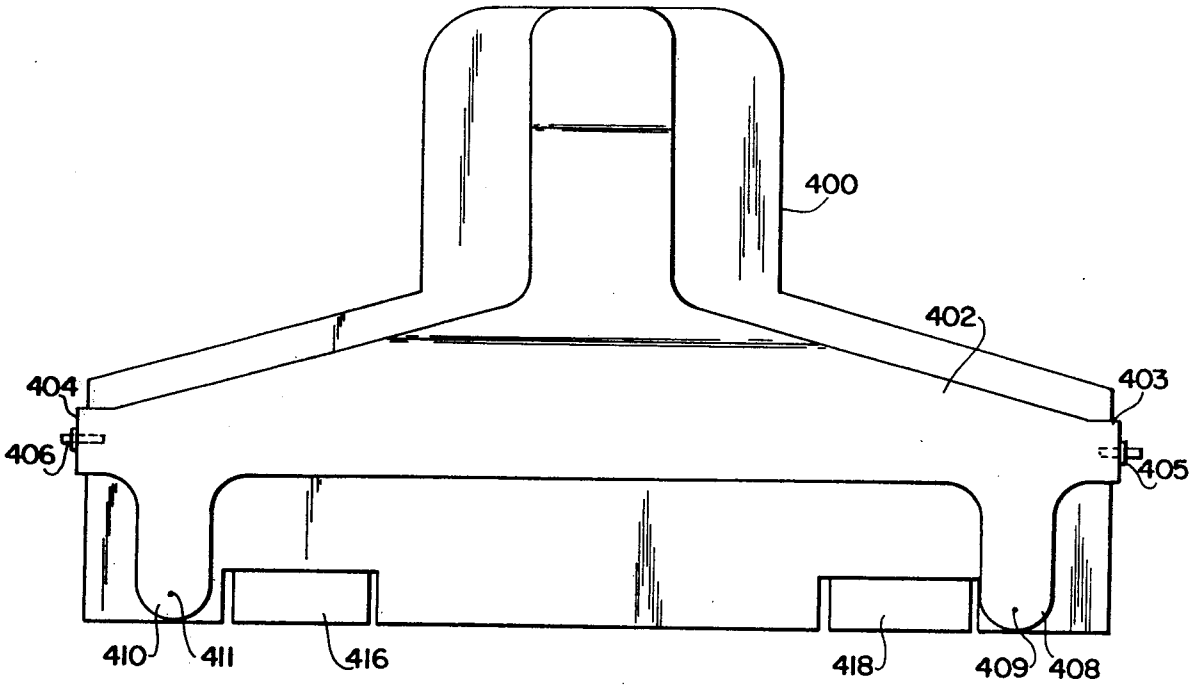
Figure 7E:
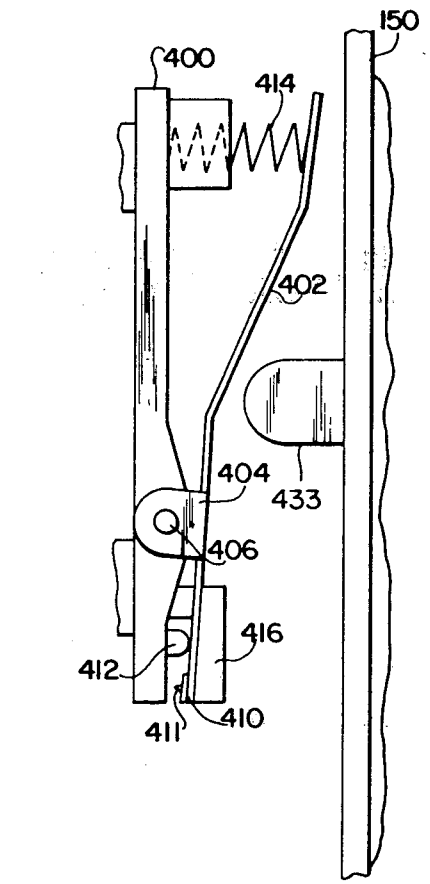
FIG. 7E is a side elevation view of a release mechanism associated with the transport mechanism.
Figure 7C:
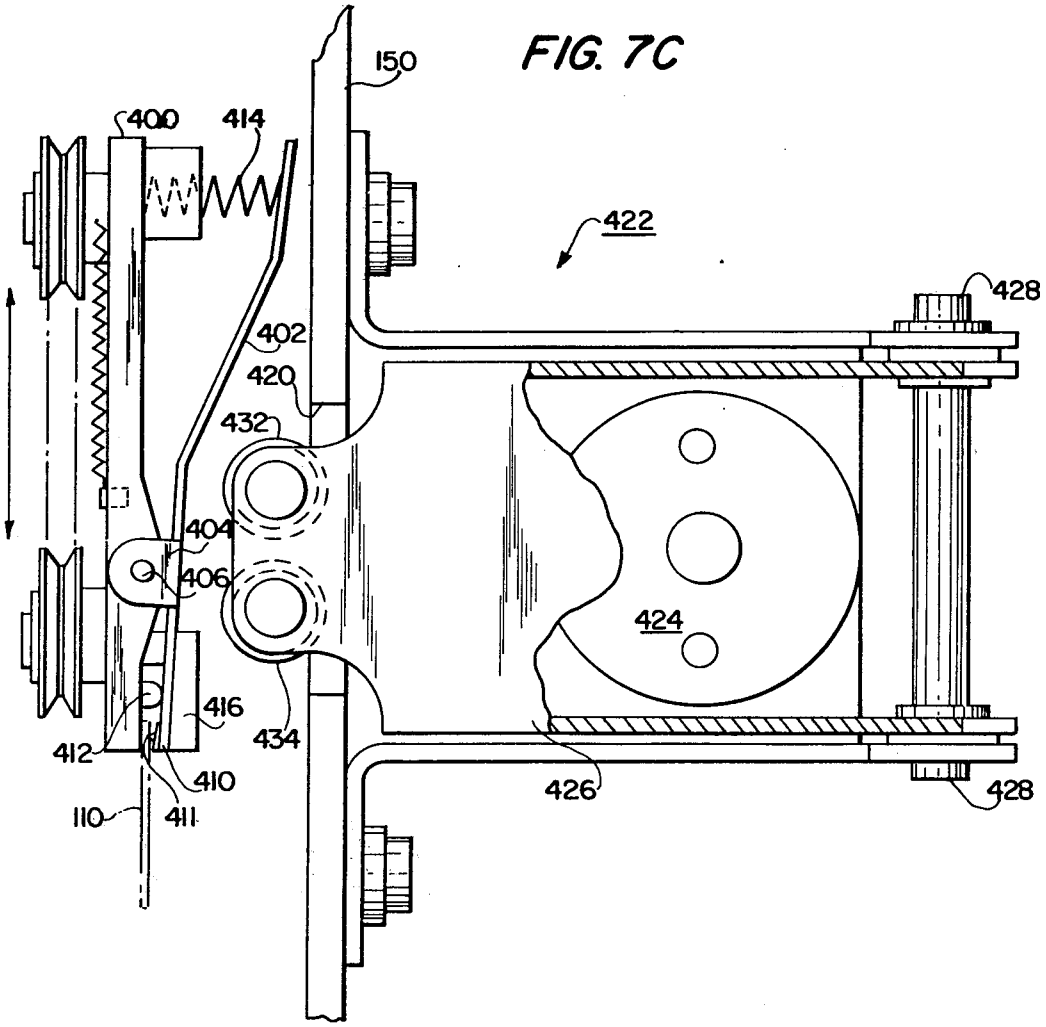
Figure 7D:
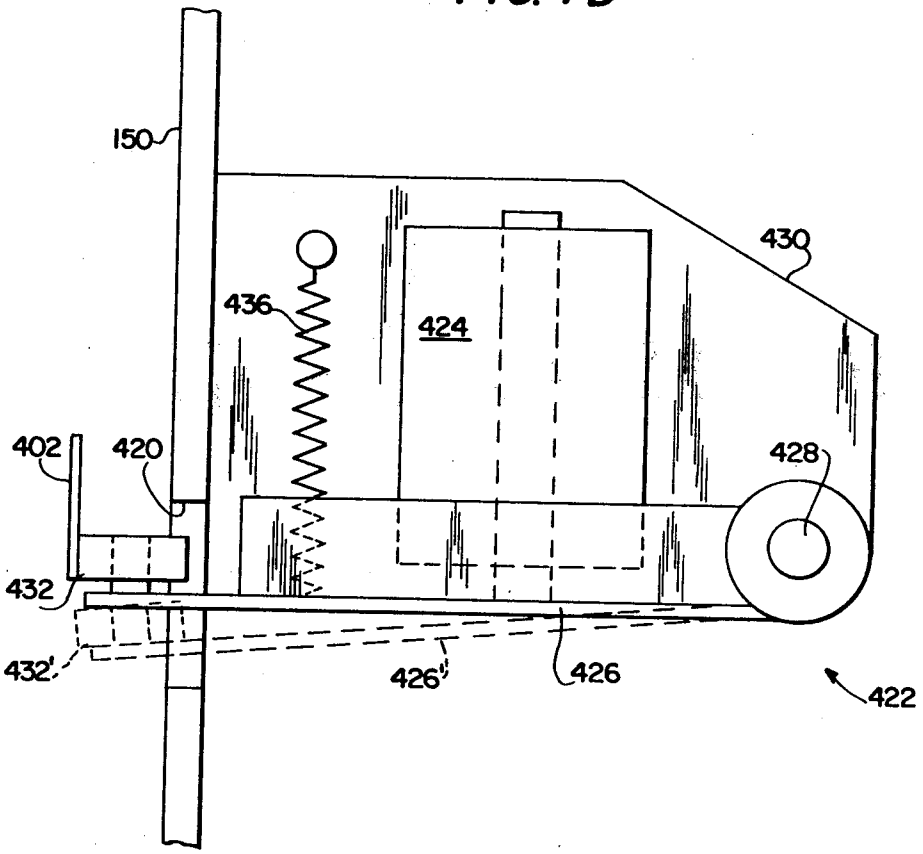

The carriage 180 of FIG. 3 is shown in further detail in FIGS. 7A–7D and generally is designated 180. FIG. 7A is a front elevation, FIG. 7B is a rear elevation, FIG. 7C is a side elevation showing moreover a release mechanism, and FIG. 7D is a top plan view of the release mechanism.

The card carriage 180 includes a main front support plate 400 and a rear plate 402 (schematically shown at 181 in FIG. 3), the plate 402 having flanges 403 and 404 for pivotal mounting to the plate 400 as shown at 405 and 406, respectively. Plate 402 further includes downwardly depending fingers 408 and 410, respectively, carrying sharp engagement pins 409 and 411 which slightly penetrate a card when gripped by the carriage as best illustrated in FIG. 7C. A stop element is associated with each of fingers 408 and 410 and is seen at 412 as to the finger 410 in FIG. 7C, to limit the inward movement of the finger and hence control the extent of engagement of the card.

A spring 414 is suitably mounted on the plate 400 and the rear plate 402 to normally resiliently pivot the plate 402 into the engaged (i.e., card engaging) position as seen in FIG. 7C. The plate 400 furthermore carries a pair of stripping elements 416 and 418, the function of which is to prevent rearward displacement of the card 110 as the rear plate 402 is pivoted to an open, or disengaged, position, thereby to release the card and thus assures that the card is removed from engagement by the pins 409 and 411.

With specific reference to FIG. 7C and 7D, the main support plate 150 has an opening 420 therein through which extends an actuating portion of a release mechanism 422. The mechanism 422 includes solenoid 424 and a plate 426 pivotally mounted at 428 to a bracket 430 to which the solenoid 424 as well is mounted, the bracket 430 being secured to the support wall 150. The plate 426 extends through the opening 420 and carriers on its outer extremity a pair of rollers 432 and 434. A tension spring 436 normally maintains the plate 426 in the card engaging position shown.

To engage a card for transport, the carriage is lowered from the position shown, causing the rearwardly inclined surface of plate 402 to engage the rollers 432 and 434 and to pivot about the pivotal mounts to its disengaged, or open position. Accordingly, when the carriage travels to the input hopper 104 to receive a new card, it is automatically actuated to the open position. A card is then raised by the feed mechanism 142 to insert the top longitudinal edge of the card within the gripping portion of the carriage. The solenoid 424 then is energized and rotates the plate 426 in a counterclockwise direction to the dotted line position of 426', 432' as seen in FIG. 7D, thereby to displace the rollers 432 and 434 from the back plate 402. Compression spring 414 (FIG. 7C) then pivots the plate 402 about pivot 406 to cause the pins 4909 and 411 to penetrate and thereby grip the card 110. As the carriage moves away from the input hopper region, the solenoid is de-energized and the plate 426 and associated rollers 432 and 434 return to their normal position.

As shown in FIG. 7E, when embossing and any other operations on the card are completed, the carriage travels to the output stacker 106 and is lowered. The back plate 402 engages a fixed camming surface 433 to pivot and, as above described, release the currently engaged card for deposit in the stacker 106.

Punch Wheel 162 and Die Wheel 160: FIGS. 8A–8E

Figure 8A:
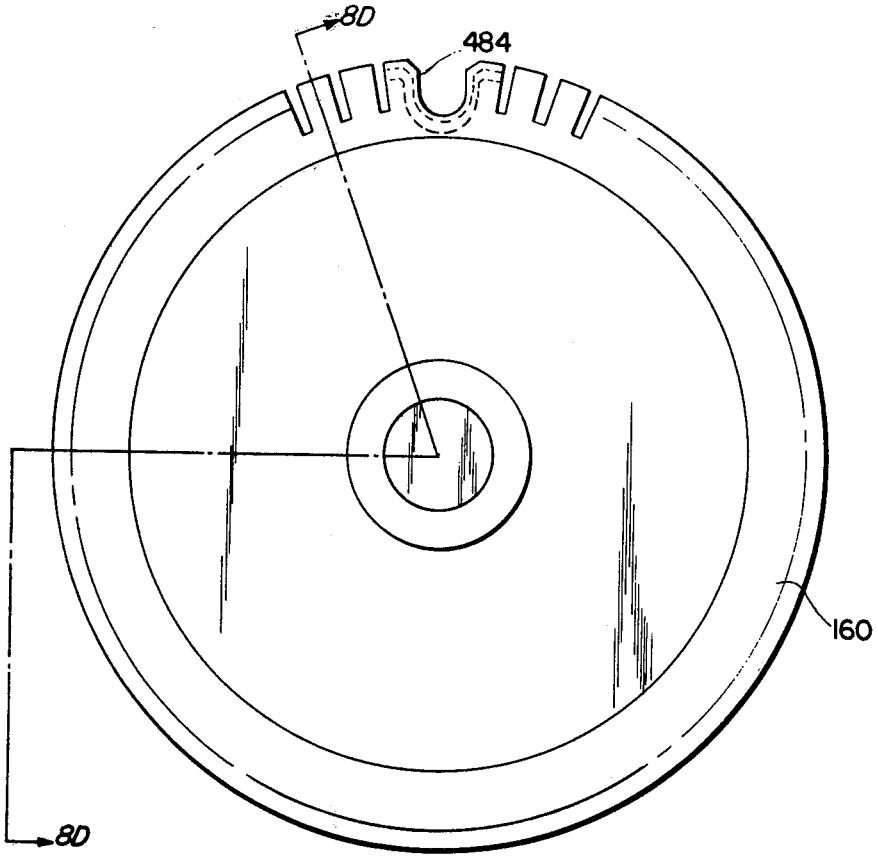
FIGS. 8A and 8B are front elevation and top plan views of the embossing wheel.
Figure 8B:
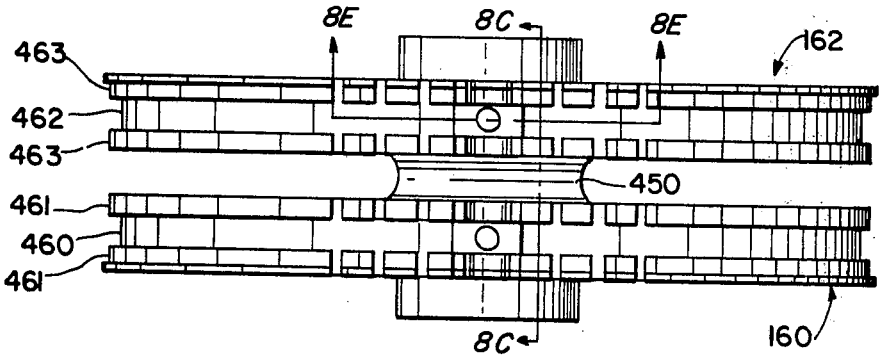

FIGS. 8A and 8B are front elevation and top plan views of the punch and die wheels, identified by the double primed numerals 160 and 162 corresponding to those elements of FIG. 3. It is seen that preferably the two wheels have a common integral hub portion 450 joining same and providing for mounting of same for rotation on wheel shaft 165 (FIG. 3).

Figure 8C:
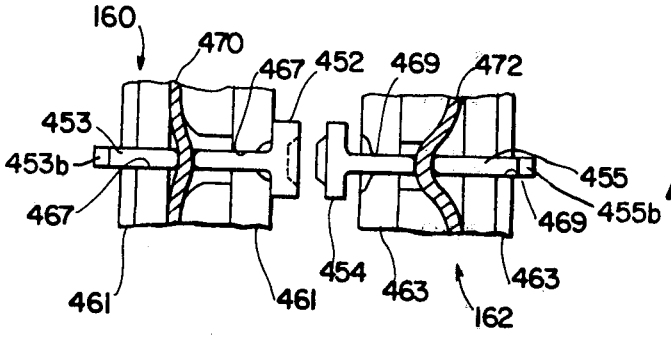
FIG. 8C is a view taken along line 8C–8C in FIG. 8A.

The enlarged detail view of FIG. 8C, taken along view line 8C—8C in FIG. 8B illustrates a die 452 and a punch 454 having respective shank portions 453 and 455. The wheels 160 and 162 respectively include circumferential channels generally designated at 460 and 462 defined by radially outwardly extending rim portion 461 and 463.

As seen more clearly in the detailed view of FIG. 8C, the rims 461 and 463 are notched as shown illustratively at 467 and 469 to receive the shank portions 453 and 455 of the punch and die pair. Several such notches are shown in the front elevational view of FIG. 8A and will be understood to extend in equally spaced intervals about substantially the entire circumference of the punch and die wheels. FIG. 8C moreover, illustrates that the channels 460 and 462 do not have the smooth continuous surface as suggested in FIG. 8B but rather define a serpentine path for receiving springs 470 and 472 and moreover that the serpentine path includes an open passageway extending to the notches in the portion of the channel adjacent the inner ones of the rims 461 and 463. Further, the shanks 453 and 455 respectively include notches for receiving the springs 470 and 472. Accordingly, the springs resiliently urge the respective punch and die to the retracted position as shown for the die 452. Conversely, the punch 454 is shown in the advanced or engaged position as required for an embossing operation. In the latter instance, the further extension of the spring 472 is apparent. Alternative resilient means, such as individual springs for each punch and die, may be provided, as is apparent.

Figure 8E:
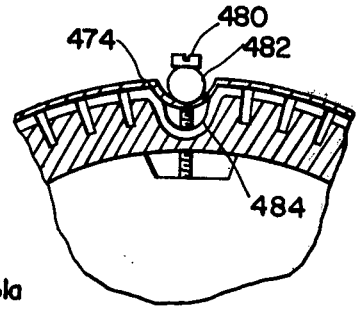
FIG. 8E is an enlarged detail view of a portion of the structure seen in FIG. 8A including additional elements therein.
Figure 8D:
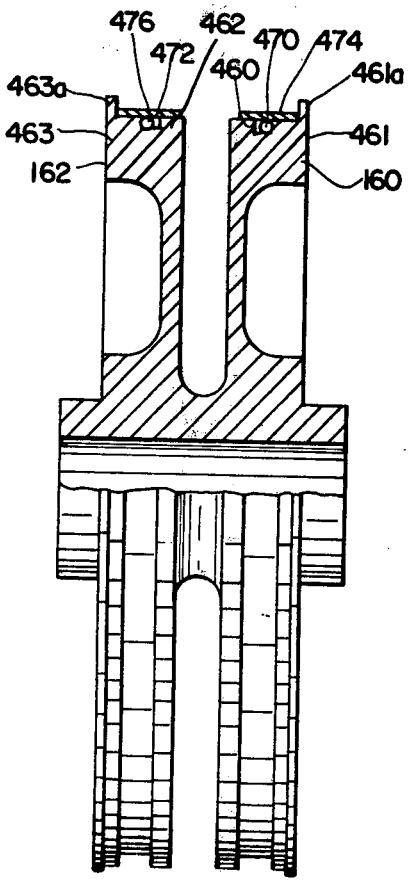
FIG. 8D is a sectional view taken along the line 8D—8D in FIG. 8A.

FIG. 8D is a sectional view taken along the line 8D—8D in FIG. 8A and serves to illustrate the disposition of the springs 470 and 472 in the respective channels 460 and 462. The view of FIG. 8D moreover illustrates that the outer rims 461 and 463 include extensions **461*a* and 463*a* whereby metal bands 474 and 476 may be received about the circumference of the wheels and axially aligned adjacent the outer rim extensions 461*a* and 463*a*. The bands 474 and 476 thus secure the springs and the punch and die pairs in position within the respective punch and die wheels. As seen in FIG. 8E, the bands 474 and 476 (only one of which is seen in FIG. 8E) are held in place by a screw assembly 480 which forces a rod 482, having a configuration corresponding to the indent 484** in the outer periphery of each of the punch and die wheels, into the recess thereby to tighten the band about the circumference of the wheels.

Figure 9A:
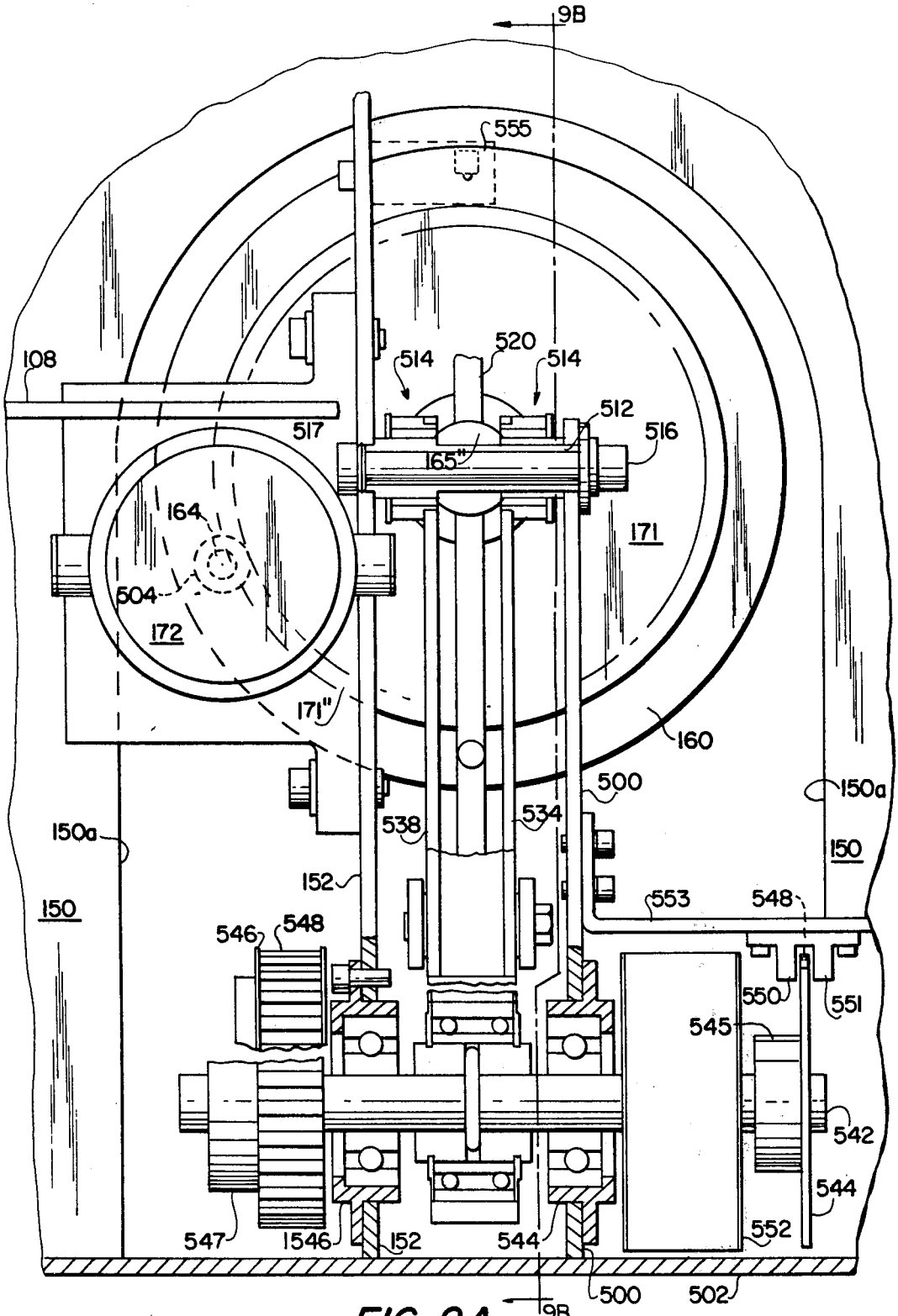
FIGS. 9A and 9B are front and side elevational views, respectively, FIG. 9A taken along the line 9A—9A in FIG. 9B and FIG. 9B taken along the line 9B—9B in FIG. 9A, each partially in section and showing the basic embossing mechanism and drive elements therefor in accordance with the system of the invention.
Figure 9B:
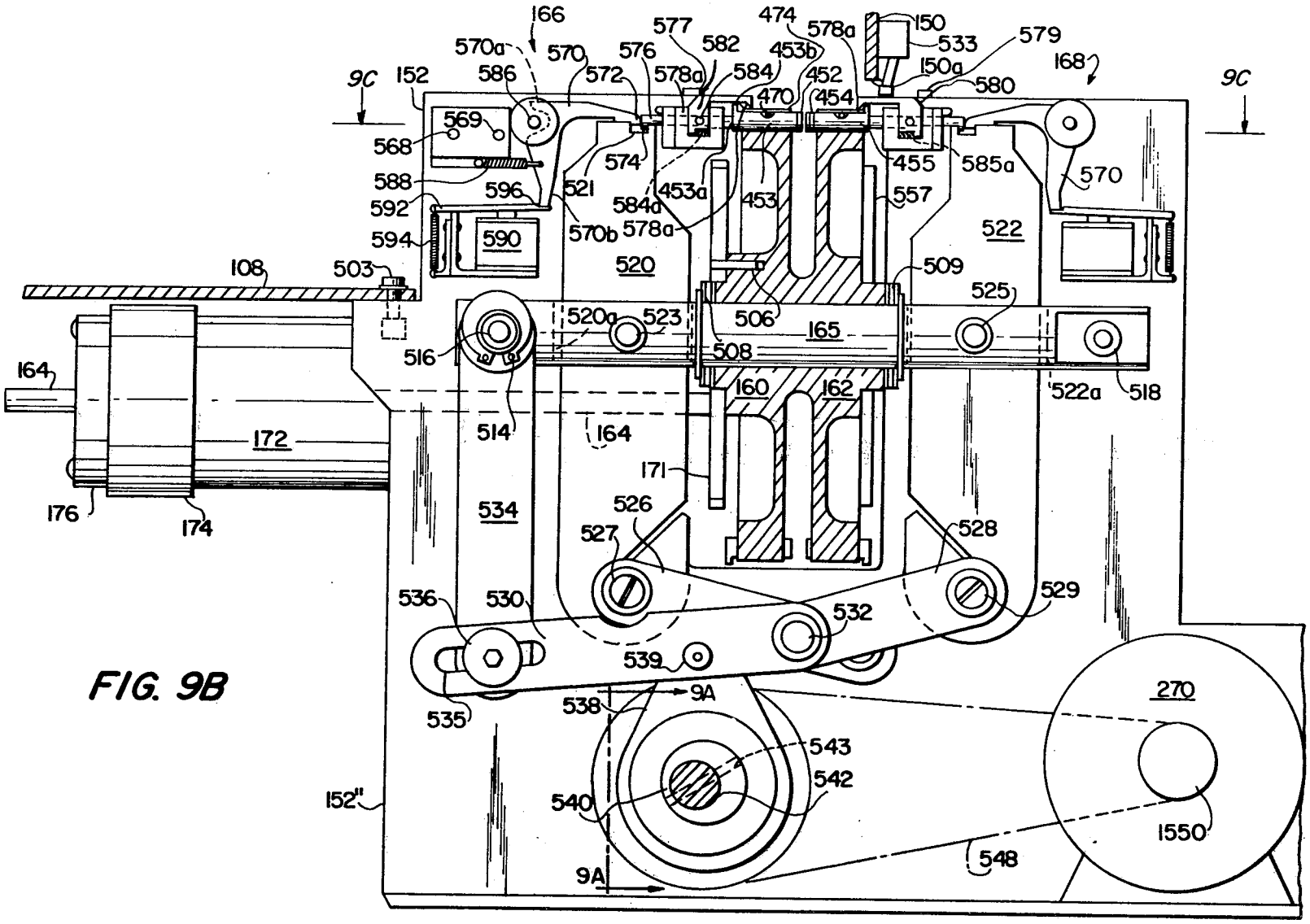
Figure 9C:
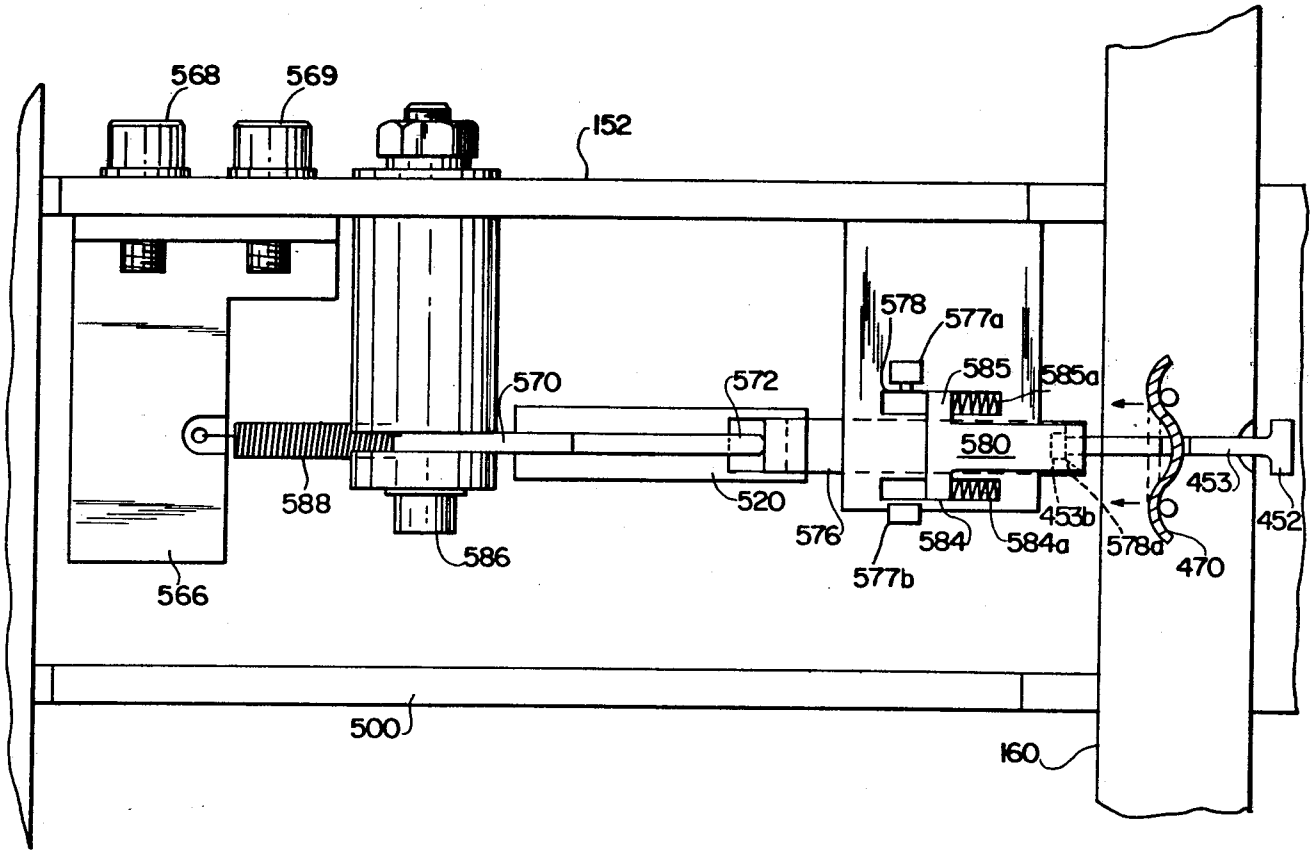
FIG. 9C is a top plan view, partially in section, of a portion of the structure illustrated in FIGS. 9A and 9B.

Driving Mechanism for Embossing Wheels 160 and 162 and Actuating Mechanisms 166 and 168 for Embossing System: FIGS. 9A–9C FIG. 9A is a front elevation view, partly in cross section, of the drive mechanism for the embossing wheels and the actuating mechanism 166 for the embossing elements of the front wheel 160 and particularly the die elements, carried by the wheel 160. The cross section of FIG. 9A is generally taken along the line 9A—9A in FIG. 9B which correspondingly is a right-side elevational view (i.e., in FIG. 3, a side elevational view taken from the right-hand side) and more specifically is taken generally along the line 9B—9B in FIG. 9A. FIG. 9B shows, in cross section, portions of the drive mechanism for the wheels and also of both the embossing actuating mechanisms 166 and 168. FIG. 9C is a top plan view, partly in cross section, taken along the line 9C—9C in FIG. 9B.

FIGS. 9A and 9B show the main support plate 150″ including the cutout **150*a*″ through which the embossing wheels 160″ and 162″ extend, and also the horizontal support plate 108″ and the secondary support plate 152″. FIG. 9A further shows a further secondary support plate 500 which is removed in FIG. 9B, both figures showing moreover a base support 502 to which the plates 150″, 152″, and 500** are secured.

The servo motor 172″, through its shaft 164″, drives a spur gear 504 (FIG. 9A) which engages the rim gear 171″ which is secured by pin 506 to the integral embossing wheels 160″ and 162″ (FIG. 9B). Bearing structures 508 and 509 provide for rotation of the embossing wheels about the wheel shaft 165″. The wheel shaft 165″ moreover is suitably mounted to the horizontal plate 108″ in a manner to be described. The motor 172″ is secured to the horizontal plate 108″ by a suitable bolt arrangement as illustrated at 503.

As seen in FIG. 9B, the motor 172″ drives an optical encoder 174 and a tachometer 176 to provide position and velocity feed back information.

In FIG. 9A a shaft 512 extends transversely through an opening in the wheel shaft 165″ and carries bearing structure 514 thereon to provide pivotal mounting of certain movable connectors to be described. The bolt 516, the shank of which may comprise the shaft 512 itself, passes through suitable openings in the secondary plates 500 and 152″. The bolt 516 and the associated bearing structure 514 as seen in FIG. 9B are disposed at one extreme (here, the front extreme) of the wheel shaft 165 and hence supports same at that end. The opposite end of the wheel shaft 165, while not having the bearing structure, is provided with a similar bolt arrangement 518 to mount that end of the wheel shaft to the same support plates and thereby to rigidly position the wheel shaft 165.

The basic actuating mechanism for the punch and die pairs constitues a corresponding pair of front and rear bail arms 520 and 522 which extend through corresponding vertical channels **520*a* and 522*a* cut through the wheel shaft 165 and are mounted to the wheel shaft by corresponding pivotal connections 523 and 525**. The extent of pivotal movement of the bail arms is quite limited, as will later be appreciated from the description of the actuation of the punch and die pairs.

The bail arms are driven in continuous oscillatory motion by links 526 and 528 connected thereto by pivotal connections 527 and 529, respectively, the links 526 and 528 being pivotally interconnected in common to a dwell control link 530 at pivotal interconnection 532. Dwell control link 530 furthermore is pivotally interconnected to the adjustment link 534 by pivotal connector 536 which may be adjusted within the slot 535 of the dwell control link 534. Adjustment link 534 is connected to the wheel shaft 165 by the pivotal mount 514 previously noted. The adjustable slot 535 permits selecting the relative position of interconnection of connecting link 534 to the dwell control link 530 with the effect of altering the amount of travel of the rear bail arm 522 (which controls the actuation of the punch). From FIG. 9A, it will be seen that there are two such adjustable links 534 and 538, only one thereof being visible in FIG. 9B.

The dwell control link 530 is connected by pivot 539 to an eccentric arm 538 driven by the eccentric 540 which is fixed to shaft 542 for common rotation thereof, as indicated by the interconnecting pin 543.

With concurrent reference to FIGS. 9A and 9B, shaft 542 is mounted in secondary wall 500 by bearings 1544 and in the wall 152 by bearings 1546 for rotation, and is driven in rotation by a timing belt pulley 546 secured to the shaft 542 by its associated hub 547, the pulley 546 receiving the timing belt 548 (FIG. 9B) which in turn is driven by the timing belt pulley 1550 of the motor 270. A fly wheel 552 is mounted on the shaft 542 which by appropriate shaping, also functions as a counterbalance to maintain uniform rotation of the shaft 542 during the embossing cycles.

A timing disc 544 is secured to the shaft 542 by a hub 545 and includes an arcuate slot 548 providing a position indication in conjunction with the light source/-photocell detector 550, 551; the latter is secured to bracket 553 mounted on the plate 500.

A further photocell detector is shown at 555 (FIG. 9B) mounted on the wall 152 to scan the periphery of a slotted disc 557 (FIG. 9B) and provide a signal when the type wheel 160, 162 is at a known zero, or reference position.

The actuating mechanisms 166 and 168 in those portions which directly control the engagement of the punch and die pairs are identical in the portions thereof driven by the associated bail arms 520 and 522 and hence only one thereof, and particularly mechanism 166, is now described. With reference to FIGS. 9B and 9C, the die shank 453 received in the wheel 160 is shown as including the return spring 470 and the retaining band 474 as previously described.

As before noted, the basic actuation motion for the punch and die pairs is provided through the continuous reciprocating pivotal movement, i.e., oscillatory movement, of the bail arms 520 and 522. The aforedescribed eccentric 540 and link arrangement causes the bail arms to move to engaged positions and to return in each complete revolution of the eccentric. The bail arms therefore provide the motive force for the embossing function. That motive force is conveyed to the punch and die by means of an interposer 570 having an end portion, or tip 572 which is received in a slot, or recess, 521 of the bail arm 520 and, when so received therein as shown in FIG. 9B, effects a wedging action with the extension or tail portion 574 of an intermediate driver 576, that intermediate driver 576 extending through a housing 578 to engage the rear end of the punch 453, as shown at 453*a*. The intermediate drive housing 578 is suitably mounted on the wall 152 to support the intermediate driver 576.

A retractor 580 includes a pair of downwardly depending arms 582 (only one of which is seen in FIG. 9B) carrying projections 584 and 585 which are received in slots in the side walls of the housing 578 (as seen in FIG. 9C, wherein the illustration of the intermediate driver 576 extending through the housing 578 is in dotted lines). Springs 584*a* and 585*b* are retained within the housing 578 and urge the retractor 580 to the position indicated. Retractor 580 includes a downwardly depending cammed surface 578*a*. In operation, when the intermediate driver 576 forces the die shank 453 forward into the engaged, embossing position, the raised tip 453*b* of the die shank 453 engages the cammed surface 578*a* and moves the retractor 580. (In the view of FIG. 9B, the punch and die are not completely engaged; upon further movement into a fully engaged position, the tip 453*b* would engage and raise the retractor 578 in the manner described.) When the embossing is completed and as the cycle continues, the bail arms return and springs 584*a* and 585*a* urge the retractors to its normal position shown, thus withdrawing the punch and die to their rest, or disengaged positions. The cammed surface 578*a* of each retractor 580 assures that the dies (and likewise, the punches) are properly returned to a rest or non-engaged position in the respective wheels as same are rotated to a new position.

The interposer 570 is mounted for both pivotal and translational movement with regard to a shaft 586 and accordingly includes a cutout portion 570*a* received in sliding engagement over the shaft 586. An interposer spring 588 normally maintains the surface 570*a* in engagement with the shaft 586 and hence maintains the interposer in its withdrawn condition normally.

In operation, the interposer 570 must be rotated to insert the interposer tip 572 into the recess 521 of the bail arm 520, such that during the subsequent movement of the bail 520 (clockwise rotation in FIG. 9B about pivot 523), the interposer tip 572 is engaged on its trailing edge by the rear side wall of the recess 521 and its leading edge engages the tip 574 of the intermediate driver 576 whereby the latter is moved forward as the bail arm oscillates in a forward direction to engage the punch and die and perform an embossing operation. The bail arms 520, 522 continuously oscillate and thus could provide an embossing operation during each oscillation interval; however, an embossing operation is performed only if a card is properly positioned for being embossed by the punch and die pair currently rotated by the type wheels 160, 162 into position at the embossing station. This implies, therefore, the ability to control the position of interposer 570 and particularly to selectively position the interposer tip 572 within or without the recess 521 of the bail arm 520. That selection function will now be described.

The particular sequence of operations of the interposer can be appreciated by reference to the above referenced U.S. Pat. No. 3,638,563 and particularly FIGS. 7 through 11 thereof and the discussion in the specification at column 5, lines 30 et seq. Very generally, the interposer spring 588 normally holds the interposer 570 in the withdrawn position with the recess 570*a* closely engaging the pivotal stop 586. Moreover, prior to any embossing operation, solenoid 590 is normally de-energized and hence the clapper plate 592 is rotated to its upward position, as shown, under force of spring 594. The lip 596 of the clapper plate 592 thus engages the lower edge of the depending arm 570*b* of the interposer 570, providing a fulcrum whereby the spring 588 rotates the interposer 570 about the lip 596 in returning it to a withdrawn position, thereby raising the interposer tip 572 out of the recess 521 in the bail arm 520. When an embossing operation is to occur, and in timed relation with the rotation of the bail arm 520 to a withdrawn position (counterclockwise in FIG. 9B) the solenoid 590 is energized, retracting the clapper plate 592. Interposer spring 588 then rotates interposer 570 about the pivotal stop 586, causing the tip to drop down into the recess 521 in the bail arm; recalling that at this time, the bail 520 has been rotated to a withdrawn position, it will be readily appreciated that the recess 521 is aligned with the interposer tip 572 to receive same therein. Thereafter, the bail arm 520, continuing in its oscillatory movement, pivots about pivot point 523 with the interposer tip 521 and the intermediate driver tip 574 commonly received within the recess 521. The clockwise rotation of the bail arm 520 (as seen in FIG. 9B) moves the interposer 570 to a forward position. In FIG. 9B, the punch and die are almost engaged; some slight further movement would be required to complete the engagement and perform an actual embossing operation.

The solenoid 590 is de-energized almost immediately following energization and hence the clapper plate 592, by virtue of spring 594, returns to its open position. As the interposer 570 is moved further during the embossing cycle, above described, the depending arm 570*b* likewise moves forward over the cut edge 596 and hence again engages that edge 596. As the embossing cycle continues, the counterclockwise rotation of the bail arm 520 returns the interposer which, under the force of spring 588, pivots about the edge 596 and removes the tip 572 from within the recess 521. When the embossing function is to be performed, the solenoid 590 is momentarily energized in timed relation to the oscillatory movement of the bail arm to engage the interposer in the recess 521 and permit a single embossing operation to occur and then the interposer is withdrawn during that return oscillatory movement of the bail arm, within each embossing cycle.

A photocell detector or sensor, schematically shown at 577 in FIG. 9B, and shown more clearly at 577*a*, 577*b* in FIG. 9C, is normally blocked by the retractor 580, it is unblocked as the retractor is pulled forward by the die shanks 453 during an embossing operation; following the embossing operation and as it withdraws, or retracts, die shanks 453, by action of springs 584*a*, 585*a*, it again blocks the detector 577. This sequence of events results in a corresponding set of outputs from detector 577 which indicates both that the die shanks 453 did in fact move inwardly to perform an embossing operation and that it was properly withdrawn thereafter. A corresponding photocell detector 579 is provided for the die shanks 455, as seen in FIG. 9B. The outputs of the detectors provide what is termed an "echo check" for the embossing punch and die pair, i.e., the proper sequence of the detector outputs, when detected, following a command to emboss, confirms that the embossing function occurred properly.

Figure 10:
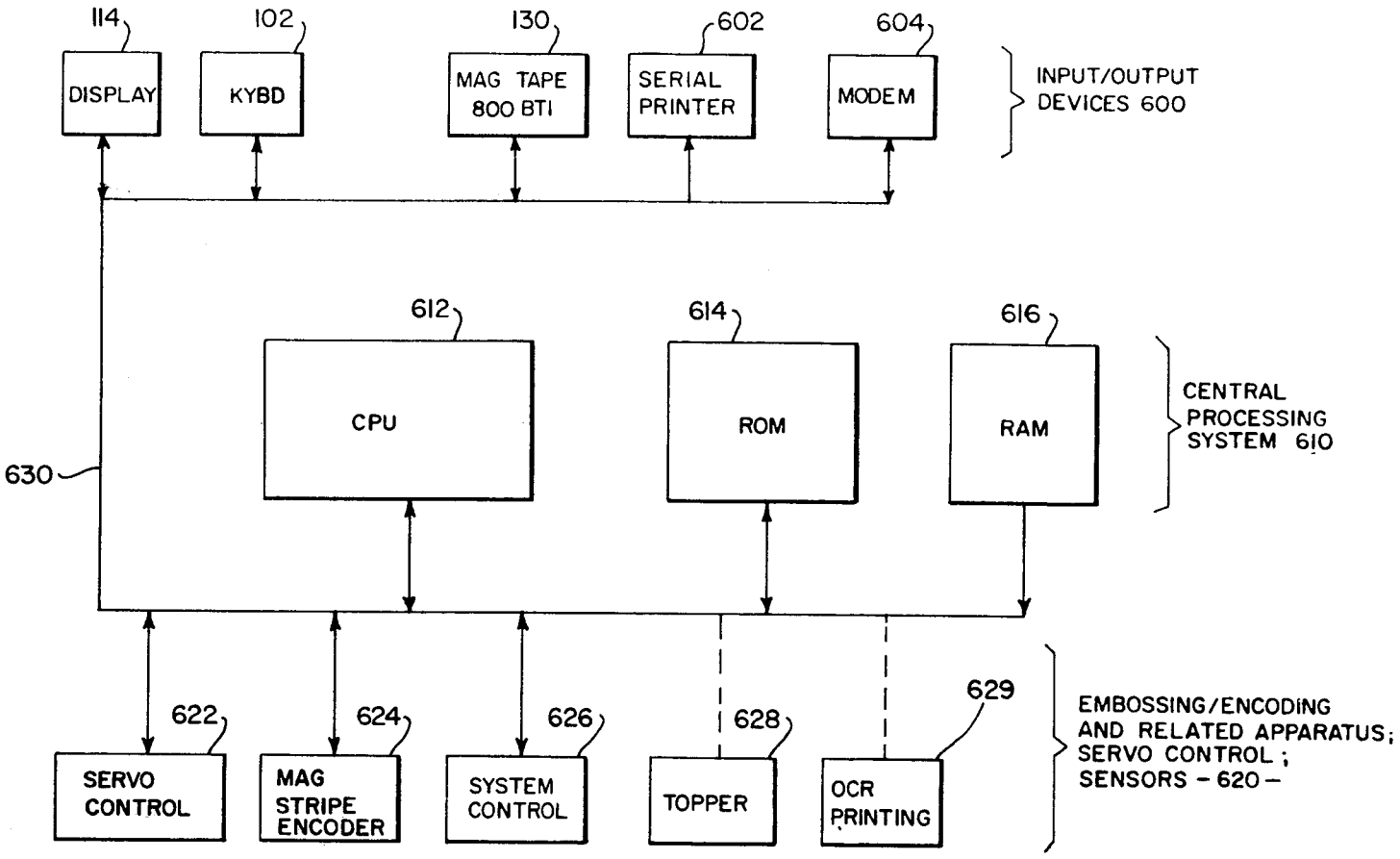
FIG. 10 is a block diagram of the system of the invention including data processing and control systems employed therein.

FIG. 10 is a generalized block diagram of the embossing system of the invention, illustrating the basic organization of its various sub-assemblies and the control interconnections therebetween. Specifically, input/output devices 600 may include the display 114, the keyboard 102, the magnetic tape system 130", corresponding to those elements shown in FIG. 1 and identified by identical numerals and optional elements such as a serial output printer 602 and a modem 604. The serial printer as later discussed may provide a print out of information being embossed on cards and/or other information, as desired. The modem 604 alternatively may receive information to be embossed or encoded on cards by the system of the invention or conversely may transmit information concerning current operations of the system to a remote location.

The central processing system 610 includes a central processing unit (CPU) 612 which may comprise a microprocessor, a random access memory (RAM) 616 and a read only memory (ROM) 614 which may be a programmed ROM (PROM) for storing various routines performed by the CPU and as well various specific encoding and card format information required by a given customer or user of the system, e.g., particular location of embossing lines on a card, encoding format of magnetic encoding to be provided, etc.

Random access memory (RAM) 616 principally functions to store the information being processed for a given card, and more specifically, includes first and second portions each capable of storing a maximum predetermined amount of data which is associated with a single card. In general, the RAM 616 is loaded in alternate sequence as to the two memory portions, the system operating on the data in the one memory section while the other section is being loaded.

Portion 620 of the basic block organization of FIG. 10 generally corresponds to the embossing and encoding apparatus as hereinabove described with reference to FIGS. 1 through 9 and particularly illustrates both controls to such apparatus and sensor outputs from such apparatus. Specifically included is a servo control block 622 which receives outputs from the position and velocity encoders associated with the various motors as hereinabove described and as well outputs from the photocell detector 555 (shown in FIG. 9A) associated with the type wheels 160, 162 which defects the zero or reference position thereof, thereby to produce a return-to-zero signal indication output thereof, and the photocell output from the timing disc sensor 550–551 associated with timing disc 544 mounted on the shaft which drives the bail arms 520 and 522 in their oscillatory motion. That shaft rotation establishes the basic embossing cycle and in fact the basic timing reference of the system. The servo control block 622 as well receives controls from the CPU 612 for controlling the driving of the horizontal and vertical card transport mechanism, and of the type wheels 160, 162 for locating the punch and die pair for a desired character at the embossing station.

Portion 620 further includes a magnetic stripe encoder 624 for receiving data from the RAM to be encoded on a given card and receiving controls from the CPU 612 for proper timed recording of that data on the mag strip of the card.

System control block 626 communicates with the CPU 612 both to provide various sensor outputs and to receive various control inputs. For example, in relation to the feed mechanism 142 (FIGS. 5A–5C) the timing disc 273 driven by the motor 272 and the associated photocell detector 275 produce an output for indicating the picker motor position. Also another photocell sensor 315, 317 (FIG. 5A) is provided to detect when a card is successfully picked from the input hopper. Specifically, the card, when picked, blocks the light path and the output thus confirms both that there is a supply of cards in the input hopper and as well that the card has been properly fed; further, when the carriage engages and thereafter removes the "picked" card from the input hopper, the sensor 315, 317 is unblocked, the output indicating this condition as well. A further sensor input associated with system control 626 is the echo check outputs of detectors 577 and 579 discussed in relation to FIGS. 9A–9C which confirms that the punch and die sets have moved and performed an embossing operation when a suitable command to do so has been generated, and thereafter have returned to the rest positions. Yet another sensor output associated with system control 626 is that of sensor 388 associated with the timing disc 386 driven by the motor 376 for operation of the paddle 370 (FIG. 6B) to detect and thereby indicate the position of the paddle in the output stacker. (It will be recalled that that paddle must be moved in accordance with displacing a card into either the reject or accept portions of the output stacker as a function of data processing and/or mechanical errors occurring or not occurring respectively in relation to processing of necessary data and controls for the embossing of a given card).

Also included in portion 620 are the topper 628 previously mentioned as an optional element in the discussion of FIG. 3 hereinabove. A further optional component includes an OCR printing module 629 which can print OCR characters on the card if desired.

Communication between the various blocks illustrated in FIG. 10 is over a common interconnection bus 630 comprising an eight line parallel bus for bi-directional transmission of 8-bit data words in parallel. Transmission over the bus 630 is effected in a time multiplexed manner; the 8 lines accommodate 8-bit data words for this illustrative implementation, and certain of the eight lines also carry control signals.

Embossing Locations and Character Types: Embossed Card 110 (FIGS. 11A and 11B)

Figure 11A:
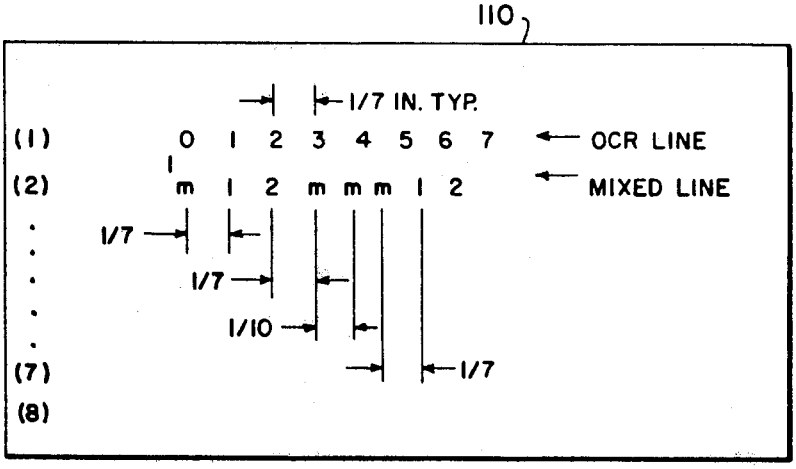
FIGS. 11A and 11B comprise schematic indications of a credit card to indicate the nature of embossing and magnetic encoding, respectively, thereon.
Figure 11B:
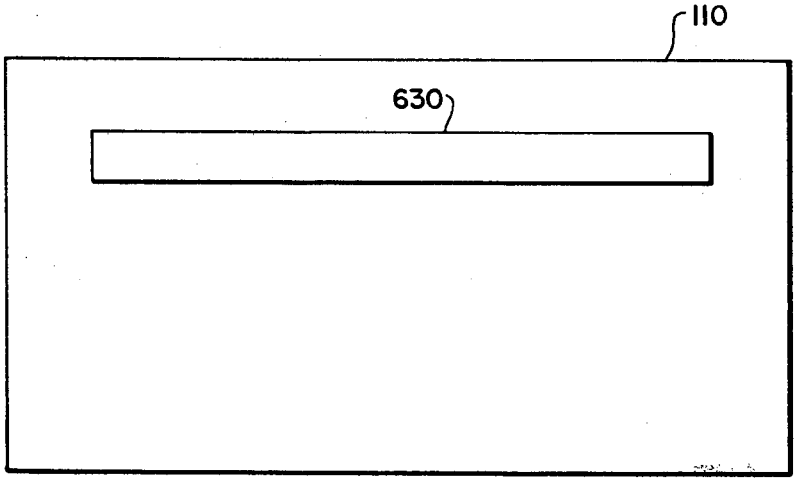

FIGS. 11A and 11B show the front and rear sides of a typical credit card, FIG. 11B being included merely to illustrate the provision of the magnetic stripe 630.

FIG. 11A illustrates the type of embossing which can be performed in one embodiment of the invention. Specifically, eight separate horizontal lines of embossing may be provided, and each line may include either larger or smaller type characters correspondingly embossed at intervals of 7 per inch or 10 per inch, respectively. Typically, OCR characters are of the larger type at the 1/7th inch spacing. As later described, a mixed line of larger and smaller characters may be provided as shown in line 2. As will be apparent, the particular characters which are embossed will be determined by the types of embossing punch and die pairs installed in a given machine. As will later become apparent, the selection of characters for embossing is dependent only on the particular location in the embossing wheel and hence the internal processing of data relates to codes identifying the angular position of the embossing wheel and is independent of the specific characters represented by the punch and die pairs. Accordingly, any desired characters may be installed in the system. Further, it will be apparent that alternative embossing wheels with suitable modification of coding will permit, up to the capacity of a given embossing wheel, the use of any desired type, size or number of characters. In actual practice, depending upon size of characters, from 42 to 92 different characters and symbols (e.g., punctuation and other symbols) have been implemented in a given system.

Information Format: Data Entry

Data may be entered either from the keyboard 102 or by reading of the magnetic tape or transfer system 130". Since the information recorded on the tape corresponds to the same format as keyboard entry, the latter will be described.

The information format is as follows:

| INFORMATION FORMAT | |
|---|---|
| 1 | line no. (1 THRU 8) |
| λ | SPACE |
| 7/IN | character spacing code (7/IN /10/IN key) |
| λ | SPACE |
| 1 | line location in thousandths from bottom card edge |
| 3 | |
| 1 | |
| 5 | |

As noted, the line number may vary from 1 to 8, the top line of embossing on a card always being line 1. (See FIG. 11A). The vertical line location, although alternatively entered merely by a depression of an appropriate numbered key from 1 to 8, in the present disclosed embodiment is instead indicated by typing in a 4 digit number represented thousandths of an inch from the bottom edge of the card. For example, a line located 0.500 inches from the bottom edge of the card requires programming "0500".

To enter the data and in accordance with the format, initially the CLEAR key 61 (FIG. 2A) is depressed to clear the RAM 616 (FIG. 10). The LOAD LINE LOC. (load line location) button 21 is depressed, which serves to simultaneously enter two types of control information: vertical embossing line locations on the card, and a character spacing code. Character spacing may either be set to 7 characters per line or 10, by corresponding actuation of buttoms 79 and 80 or, if mixed characters are to be embossed, the SPACE code is entered by actuating the space bar 81 of the keyboard 102*a*. In addition, embossing data is designated and a coded control word EMB entered in association with the data by actuation of buttom EMB number 78; conversely, data to be magnetically encoded is designated by actuation of the encode button ENC 90 to enter a corresponding ENC code into memory. A space code further is inserted between the data for each line, in addition to the codes above indicated. Of course, if this information is entered from tape, the appropriate codes are prerecorded on the tape in conjunction with the data. Likewise, a print code can be entered from the keyboard by actuation of button 91. The print code will cause the following data to be printed out by the serial printer 602. The top form button 92 will cause such printing to occur at the beginning of each of a succession of forms, in a conventional manner (i.e., rather than merely providing continuous printing of continuous, even line spacing as would otherwise occur unless the printer were caused to advance to a specific position following each print-out). The data for each card is contained in a block which, for example, may have a maximum of 511 frames for storing the data as well as all control codes, search codes, etc. For this purpose, the keyboard portion 102*c* includes a "SEARCH" button 20 which when depressed will utilize the first six frames maximum of each block of data (as an example) to store a search code of from 1 to 6 digits in length.

When all data for a given block is given, the END DATA button 60 is depressed and a suitable code recorded.

When a complete block of data is entered on the keyboard, the write block (WRT BLK) button 58 may be depressed, thereby entering the block of data from the memory onto magnetic tape. In addition, one or more blocks of data may be organized as a file and accordingly a WRITE FILE MARK (WRT) (FM) (59) button is provided to enter a corresponding code.

Keyboard 102/Mag Tape 130 Operations

For any of the keyboard controls to function in relation to the mag tape unit, the tape transport must be in the ON LINE mode by actuation of button 120*a* in FIG. 2B. In the ON LINE mode, the other tape transport controls are ineffective. Moreover, end of tape (EOT) and beginning of tape (BOT) codes pre-recorded on the tape will be read and displayed in the display 114.

In the ON LINE mode, therefore, and returning to the keyboard controls 102*c*, when a block of data has been entered from the keyboard, depression of WRT BLK 58 causes recording of data from memory onto tape. Conversely, depression of the AUTOMATIC READ button 40 will cause data from the mag tape to be automatically entered into memory as space becomes available therein.

Depression of LOCAL button 38 places the mag tape unit in the LOCAL mode whereby further actuation of READ BLOCK FORWARD (RBFWD) button 19 will cause one block of data to be read from the tape and entered into memory. Depression of READ BLOCK REVERSE button 39 will cause the tape to move one block in the reverse direction, although no data is read. The LOCAL mode is also required for activation of the LOAD LINE LOC button 21, WRTBLK button 58 and WRTFM button 59.

The final control button for the mag tape system is the SEARCH botton 20 which permits entry of a search code on the keyboard and automatic advancing of the tape to locate the desired block. If a FILE MARK (FMMRK) code is read on the tape, the tape will stop and search will be resumed only if the SEARCH button 20 is depressed again.

Embosser/Encoder Controls

Once valid data for a card is complete in memory, whether entered from the keyboard or from the mag tape, actuation of RUN button 1 will cause cards to be fed from the input hopper and processed. Upon powering up of the system, it is in the CLEAR mode. Once placed in the RUN mode, the system remains therein until either CLEAR or HALT button 61 or 89 are depressed or until certain error conditions occur.

RUN

Once valid data for a card is complete in memory, RUN will cause cards to be fed from the input hopper and processed. If no valid data is in memory, the display will indicate NO DATA; however, the machine will automatically process cards as soon as data is received (NO DATA is displayed only at the time the RUN button is pushed, not when, after running several cards, the data is exhausted. If card processing stops for any reason except lack of data, an appropriate error message will be displayed). When the system is powered up, it will remain in that mode until CLEAR or HALT is activated, or until certain error conditions occur.

HALT

Activation of the HALT button 89 at any time causes the machine to finish processing any cards which have already been fed from the input hopper, and then to cease feeding cards until RUN is activated.

CLEAR

Activation of the CLEAR button 61 at any time invalidates all data in memory, places the system in the HALT mode and places the mag tape unit in the LOCAL mode. Any cards which have already been fed from the input hopper will be rejected.

CLEAR JAM

If the machine is in a JAM condition, actuation of the CLEAR JAM button 41 will reactivate the machine in the mode it was in when the jam occurred. Any cards which were in progress when the jam occurred will be automatically remade, provided the machine is in the RUN mode; if the machine is in the HALT mode, the cards will be automatically remade when placed in the RUN mode.

Display Indications

Display 114 may be provided by any conventional display device with a suitable decoder for decoding the various control codes and providing appropriate displayed messages to the operator. Several such displays have been noted hereinabove. Various error conditions, when detected by the system, are displayed. One display of interest is the JAM condition. For example, during feeding of a card from the input hooper, the feed photocell is uncovered. When the carriage picks up the card and removes same from the hopper, the feed photocell is uncovered. If the feed photocell is not uncovered at the proper time, the display indicates FEED ERR and the machine automatically enters the HALT mode. Once the photocell has been covered, it must be uncovered at the proper time or the machine will enter the JAM mode and the display will indicate FEED JAM. Other conditions causing the JAM mode include failure of a card to cover the output photocell near the output stacker within a proper time interval following its initial feed, or the condition that one of the servos does not reach a commanded position within a certain time. Similarly, if the type wheels do not return to their rest or zero position following embossing a card, a JAM condition will result. Under any of the JAM conditions, power is removed from the servos and the embossing motor, and the display indicates JAM. Further display indications include the full condition of either the output (accept) or reject portions of the output hopper detected by switches 51 and 52, resulting in the machine entering the HALT mode.

Data Processing Operations

The general philosophy of data processing, or manipulation, in the subject system is to analyze the data representing characters to be embossed in relation to the system mechanics, and particularly, the position of the embossing wheel and the possible horizontal and vertical (X-Y) positions of the card to be embossed, as positioned by the carriage mechanism. As will be recalled, the ROM 614 stores various configuration information regarding the mechanism including the sequence of embossing characters on the embossing wheel and the various X, Y coordinate positions of the card carriage. As to the latter, the horizontal and vertical transport mechanisms may have a "0" (zero) reference position, such as the upper most left position of the carriage which the carriage assumes upon completion of embossing of a card and depositing same in the output stack here. It will be in the uppermost position since the lines are embossed on the card in the line number sequence as shown in FIG. 11A and hence, line 8 is the last line to be embossed which implies the highest position of the carriage.

The distance from the reference point to the input hopper for engaging a newly picked or fed card then is a known X-Y displacement. Likewise, the distance of movement of a carriage from the input hopper to the first embossing position of a card is known.

Further regarding the general philosphy of operation, the system functions are organized to require the least mechanical movement with regard to the highest inertia portion of the system for the embossing operation. Thus, the embossing wheel, the highest inertial system, is selected to be moved the least. This implies that the embosser wheel is rotated only once in the embossing of each card. The card itself being far lighter, in conjunction with the carriage and the horizontal and vertical transport mechanisms, the next highest inertia system is the vertical transport, and the least is the horizontal transport. Accordingly, with the embossing wheel positioned for a given character, the card is transported horizontally through each line to each position requiring that character embossment and then indexed vertically to the next line and transported horizontally through that line, until all embossing character positions of each line, for all lines in sequence, have been presented to the embossing wheel to receive embossment of the given character at the current type wheel position. The type wheel is then indexed and the card transport repeated, until all characters to be embossed have been embossed.

It therefore follows that the data must be analyzed to determine which character position in each line, for all lines in succession, which are to receive a given character embossment and, as to the characters, for each character in the succession in which those characters are provided by the embossing wheel.

To continue the general description for a moment, in the above comments regarding transport of the card from the input hopper to a first embossing position, this first position will not necessarily receive the first character to which the wheel is rotated. Instead, a different card position may be intended to receive an embossment of that character. Accordingly, a further calculation may be required to determine a further displacement of the card to a subsequent embossing position on a given line or to a subsequent line even, prior to the first embossing operation occurring.

Accordingly, the input data stored in the RAM 616 for a given block and thus a given card is analyzed, in the sequence which it is presented and stored, to establish three control numbers for each character. The first control number is the type wheel address for that character. The second control number is the horizontal location of that character measured from an arbitrary zero reference. This reference is the aforedescribed first embossing position on the first line of embossing locations on the card. Moreover, as before noted, the first embossing location for all lines are vertically aligned and hence, the zero horizontal location reference is common for all lines. It moreover, follows that the first embossing location is a specific distance relative to the left-hand or leading edge of the card. As also before noted, different character spacings are required for the different types of characters and correspondingly, the spacings may be 7 to 10 per inch. For convenience, using "70" as the lowest common denominator, the X-directions displacements are calculated as a function of 1/70 of an inch of motion of the card. The position encoder 224 associated with the horizontal transport motor 218 accordingly generates an output pulse for every 1/70 of an inch of motion of the carriage.

The third control number generated and stored for each character is the line in which that character occurs. In this regard, it will be recalled that the line locations are entered as four digits representing $1/1000^{th}$ of an inch and stored (after dividing by four) as numbers representing $4/100^{th}$ of an inch. Accordingly, the encoder 254 associated with the vertical transport motor 250 outputs a pulse for every $4/1000^{th}$ of an inch of movement of the card in the vertical (Y) direction.

When the three control numbers have been calculated and stored for each of the characters of each of the lines of the block of data for a given card, the particular identity of the individual characters is no longer of significance. —i.e., the type wheel, when positioned at the address defined by the first code number and when selectively actuated, will emboss the character of the given punch and die pair of that type wheel address onto the card; the card, moreover, will have been positioned at the X, Y displacement defined by the second and third control numbers, relative to the arbitrary zero reference X, Y coordinate.

Alternative schemes for sorting the embossing data can be implemented, as will be apparent to those skilled in art. A preferred approach is merely to scan through the code numbers associated with the character data stored in memory and to examine the type wheel addresses. The second and third control numbers, in sequence by line and for the successive lines having that same character code, as now identified by the common, corresponding type wheel address control number are identified and preferably stored in conjunction with the type wheel address in a further portion of memory. This scanning and examination is performed for the type wheel addresses in the ascending order for the entire block of data. Thus, the data is sorted in ascending wheel addresses with ascending line locations and ascending character embossing positions, (i.e., horizontal, or X positions) for each line location. It will seen that the horizontal position control number represents an actual physical measurement, or displacement, of the embossing character location from the zero reference. Conversely, the horizontal line location control number, rather than being a physical measurement (i.e., the coding of line location by $4/1000^{th}$ of an inch as hereinabove described) instead may be merely a code identifying a given line number, the ROM 614 then providing the count (number control) value corresponding to the required, accumulated count of the data output of the vertical transport encoder 254 for raising the card to the line designated by the second control number.

Figure 12:
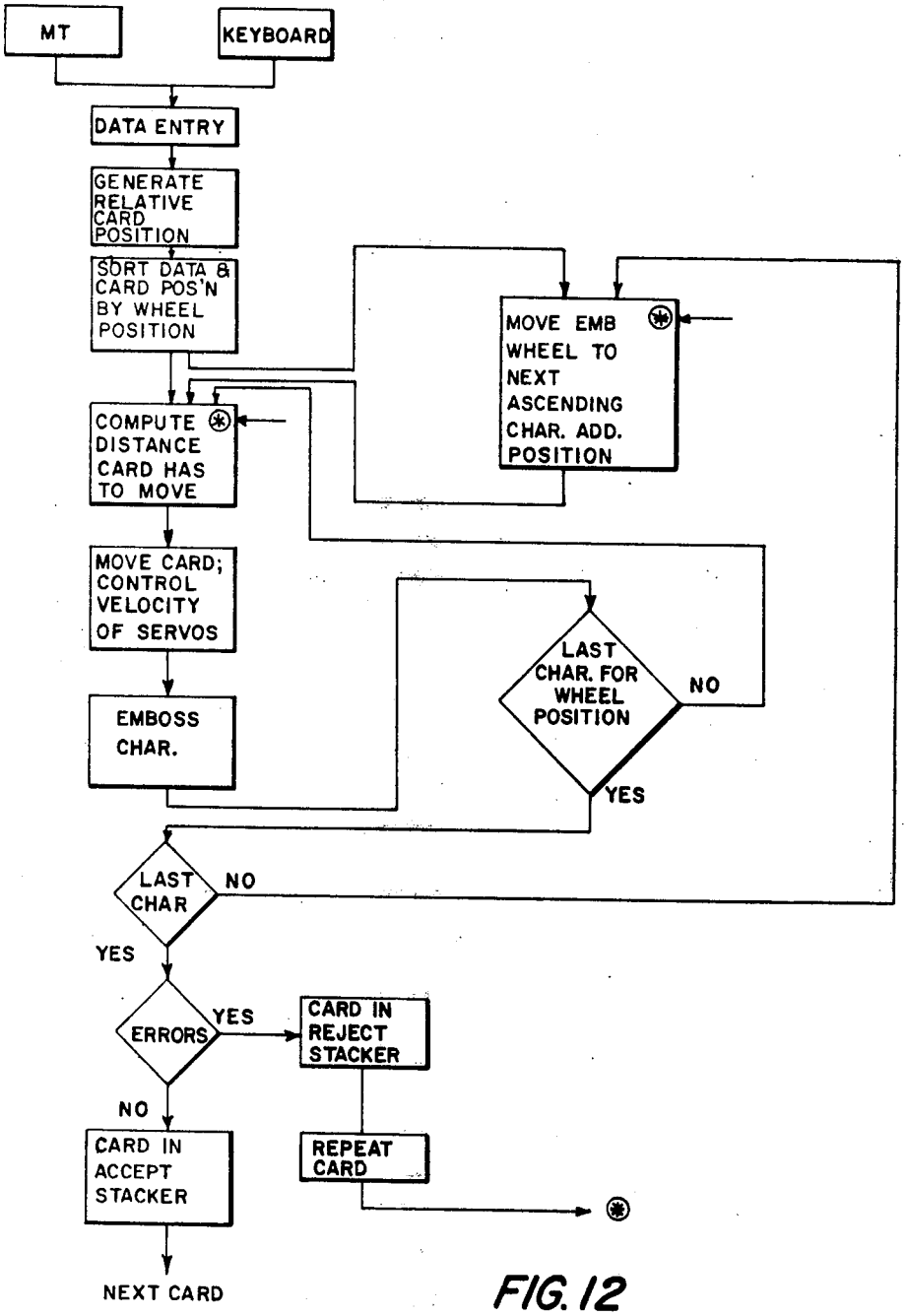
FIG. 12 is a flow chart of the operation of the system of FIG. 10.

FIG. 12 is a flow chart generally indicating these operations. Data from the mag tape or the keyboard is entered and the position and type of each character is determined relative to the 0 reference in the step labeled "generate relative card position". Following that, the data is sorted in relation to the wheel position for ascending wheel addresses, and by character position on the card.

The embossing wheel 160, 162 then is moved to the character position for the first control number thus determined and stored. Then, for that character, the distance the card has to move from its reference to each position to be embossed by that character is computed; these computations may be performed in successive computation intervals coordinated with the actual card transport and embossing operations, or independently thereof with suitable storage of the computational results. As a further alternative, the computations may be performed initially and the second and third control numbers stored in associated with each type wheel address control number may actually identify the necessary card displacement from a preceding position. The card then is moved the necessary distance, the speed of motion being controlled through the velocity servos as a function of the total distance to be moved and the motor tachometer outputs from the horizontal and vertical mechanisms. When the servo loops confirm that the card is properly positioned, the character is embossed. Each character for that wheel position is embossed in sequence by position on a given line and in succession for the successive lines. The wheel then is advanced to the next successive character address and, when the last character of the last address required to be embossed has been embossed, the card advances to the output stacker. The card is deflected into the accept or reject portions of the output stacker, as a function of the error checks. If an error occurred, data for that card will be retained in memory and an effort will be made to emboss the data onto a new card. As is typical, the number of unsuccessful repeated attempts can be limited.

Figure 13:
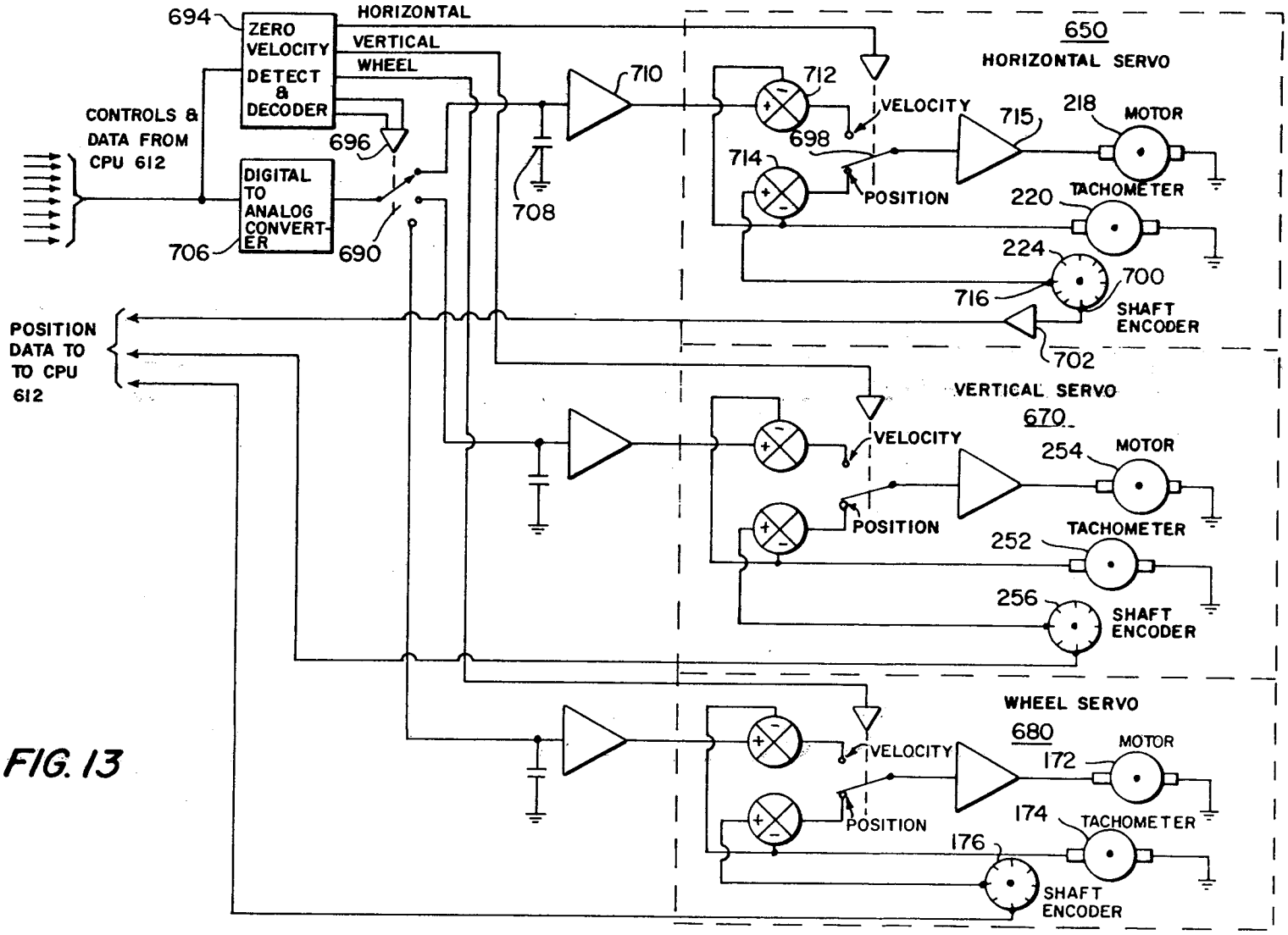
FIG. 13 is a more detailed block diagram, partially in schematic form, of the servo control loops of the control system of FIG. 10.

FIG. 13 is a block diagram of the servo control block 622 of FIG. 10 and includes a horizontal servo system 650, a vertical servo system 670 and an embossing wheel servo system 680. Each of these is substantially identical in its form and hence, only the horizontal servo 650 is described.

Shown in connection with horizontal servo 650 are the horizontal transport motor 218, and its associated tachometer 222 and shaft encoder 224. As before noted, the shaft encoder 224 outputs a pulse for every 1/70 of an inch of motion of the card in the horizontal (X) direction.

As before noted, the interconnection bus 630 (FIG. 10) is shared in a time multiplexed manner. Accordingly, in FIG. 13, switch 690 selectively connects with the horizontal, vertical and wheel servos under control of control signals received from the CPU 612 which are decoded by decoder 694 to provide the appropriate control through switch driver 696, as indicated. Whereas a mechanical switch 690 is illustrated, this, of course, would be implemented as an electronic switching device. Within each of the servos and for example, servo 650, there further is provided a velocity/position selection switch 698.

The shaft encoder 224 is shown as a two phase shaft encoder providing output transitions, the number of which indicate position displacement. Specifically, output 700 is supplied through a digitzier 702 to provide digital pulses to the CPU 612.

The CPU 612 updates the current position as pulses from 702 are received, then compares the current position of the card with the required displacement, as previously calculated, and generates a digital data word corresponding to a velocity input, and which is calculated as a function of the remaining displacement necessary for transporting the card to its destination, i.e., the next embossing location. That digital velocity word is converted by D/A converter 706 to an analog velocity value, and supplied through switch 690 (currently set to the horizontal servo 650) for storage in an analog memory schematically indicated as a capacitor 708. An operational amplifier 710 of unity gain supplies the velocity analog signal to a comparator 712 which receives at a subtracting input the output of tachometer 220. The resulting output of the comparator 712 through the switch 698, which at this time would be set to it supper, velocity control position, then is supplied through power amplifier 715 to drive the motor 218 at the appropriate speed to achieve the calculated card transport velocity.

The comparator 714 receives the tachometer 220 output at its subtracting input and the output 716 of the two phase shaft encoder 224 at its summing input, the output of comparator 714 being supplied through switch 698 in its "position" position. Switch 698 is moved to the "position" position by the zero velocity detect and decoder circuitry 694 when the CPU 612 outputs a zero velocity signal. The encoder output 716 is used as a position signal, and the servo zeros on the encoder signal zero point. The tachometer input to comparator 714 provides dynamic damping when in the position mode (any velocity signal causes the motor to be driven in the opposite direction, i.e., towards zero velocity).

Operation

The preferred embodiment of the invention operates in the manner as now described. The entire distance from the input hopper at which a card is initially grasped by the carriage to a reference position of the card relative to the embossing wheels is defined as a number of discrete displacements such as may be defined by a count of some maximum count value. For convenience and with due recognition of conventional data handling circuits, it has been found adequate to define this distance by a 16 bit word, the count capacity of approximately a maximum of 65,000 thus corresponding to 65,000 separately identifiable positions between the input hopper and the reference position of the card. A similar organization defines about 65,000 positions from that reference position of the card relatively to the embossing wheels to the output stacker. As well, the vertical displacement of the card transport mechanism both in picking a card from the input hopper and depositing same in the output stacker can be defined by digital count value words as hereinabove discussed. As also before noted, the Y or vertical displacement can be either a code number identifying a particular line location, the count value of which is stored in the RAM 616 or, conversely, may itself be a count value stored as the second control word for each character. In either case, the appropriate information is stored in the RAM 616 for these major excursions or transport paths of the card between the input hopper and the output stacker relatively to the reference position of the card with regard to the embossing wheels.

As above alluded to, embossing data for cards may be derived from the magnetic tape of transport system 130 and read directly and stored in the RAM 616 for a given card. While that stored data is being operated upon, a subsequent block of data for embossing a subsequent card may be loaded in a second portion of the RAM 616.

Preferably, the above discussed sorting of the data to place it in the order of ascending embossing wheel addresses (first control word) and then in order of the horizontal line numbers (second control word) and finally in the order of character locations within each line (third control number) is performed. With the data thus sorted, embossing operations can be initiated, preceded by the transport of the card to the embossing wheel reference position.

Figure 14:
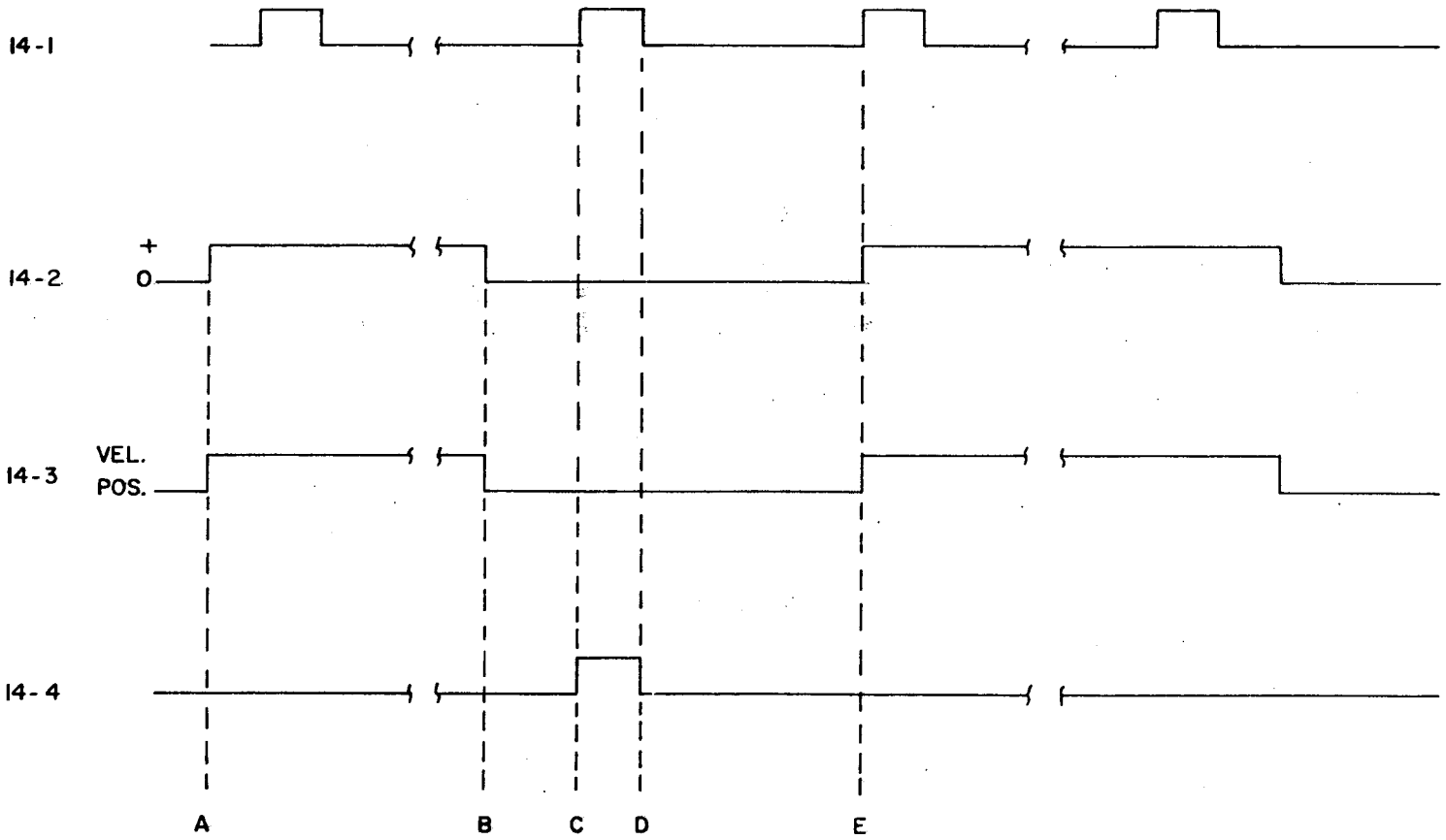
FIG. 14 is a timing chart for explaining the operation of the system of FIG. 10.

The general system timing during embossing is shown in the timing chart of FIG. 14. Waveform 14-1 is the basic timing rate of the system and is generated by the photocell detector 551 of FIG. 9A which detects each revolution of the main timing, or embossing shaft 542 which drives the embossing apparatus. Each pulse in the waveform 14-1 thus corresponds to one complete revolution of the timing disc 544 and hence of the embossing shaft.

When the card is at its reference position and with respect to the flow chart of FIG. 12, the embossing wheel is rotated to its first character address position and the sorted data in RAM 616 is read-out for the first character to be embossed and based on the second and third control numbers therefore, the distance which the card must move is computed. The card then is moved under control of the servos, which timing function is indicated in waveform 14-1. As before noted, the velocity position switch 698 of FIG. 13 is currently in its velocity position during card transport under servo control. During the interval thus indicated, the CPU 612 (FIG. 10) calculates the desired card/wheel position and then supplies appropriate velocity signals as outputs to the control circuitry and specifically the servos as seen in FIG. 13 and moreover during the interval A-B seen in FIG. 14. When the control circuitry of FIG. 13 detects that the desired position is achieved, the CPU 612 produces a zero velocity command output, illustrated as occurring at time B in FIG. 14, the command from the CPU 612 being decoded by zero velocity detect and decoder circuit 694. The latter then sets switch 698 to the "position" setting, or mode, and the servo, for example the horizontal servo 650, then locks onto the encoder output 701 to maintain that position. Specifically, comparator 714 will compare the outputs from tachometer 220 and the position output of encoder 224 to maintain the position thus achieved.

When the output 14-1 of the embossed timing photocell 551 goes high as seen in FIG. 14 and labeled as timing point C, the CPU 612 is signalled that the embossing apparatus and the card are now in the proper relative positions to emboss the character and accordingly the embossing solenoids are fired and held until the output of the embossed timing photocell 551 (14-1) goes low at timing point D. The subsequent rising of the output of the embossed timing photocell 551 (14-1) at timing point E signals that the embossing cycle is complete and the CPU 612 then energizes the servos for transporting the card to the next desired position for embossing. Again, the CPU 612 computes the distance the card must move to the next embossing position, based on the data stored in the RAM 616. The cycle then repeats, for each character of each line, in succession, and finally for all characters in succession in the ascending order of the characters on the embossing wheel.

From FIG. 14, it will then be apparent that a maximum rate of embossing will be to emboss every other cycle of the embossing shaft rotation and thus for every other emboss timing pulse 14-1. The rate of revolution of the embossing shaft and thus the rate of the embossed timing pulses 14-1 illustratively may be such to establish a 50 millisecond interval between successive emboss timing pulses, and thus embossing cycles. Accordingly, the maximum rate of successive embossing operations implies that the card can be moved to its next embossing position within that cycle and thus within 50 milliseconds. A current design of the system of the invention is capable of rotating the embossing wheel by two character positions within 50 milliseconds and of moving the card one-half of its length in either of the horizontal and vertical directions of motion thereof. Since the average time required for rotating the embossing wheel by two character positions and for moving the card about one-half of its length in the horizontal direction or one-half of the height of displaced horizontal lines in the vertical direction, this timing arrangement implies that a majority of characters will be embossed at the above noted maximum rate of one every two basic timing intervals and hence every 100 milliseconds. Since, however, greater displacements may be required, FIG. 14 illustrates a broken line in each timing function 14-1 to 14-4 to emphasize that where the card transport and hence the servo control exceeds the 50 millisecond interval, the next embossing operation will occur at the next embossed timing pulse which follows the termination of the servo control functions.

Consistent with an economical design objective, the CPU 612 may be implemented as a microprocessor having only sufficient capacity to perform the sorting operations and the data processing and servo control above discussed. Hence, data processing such as data input and sorting operations occur during different time intervals than those required for servo control by the CPU 612. A greater capacity CPU, of course, could perform such functions simultaneously or in desired time sequential, coordinated manner.

In the preferred embodiment, and for example where keyboard information is supplied for embossing, the keyboard 102 (FIG. 10) includes an input buffer having adequate capacity for storing a desired number (.e.g, 64) of characters. During embossing operations and thus in those intervals between timing points B and E in FIG. 14, the CPU can read out the buffer memory for the keyboard and store the input data in the RAM 616. Hence, the limited capacity buffer for the keyboard is sufficient to assure that, based on basic system timing functions, keyboard input data can be buffered for storage simultaneously with the embossing operations, the rate of read out of that buffer, of course, greatly exceeding the actual time requirements for embossing operations. As will likewise be appreciated, the various data processing functions in relation to the sorting of the input data requires only milliseconds of processing time. Hence, high speed operation with some time shared features of the processor contribute to maximum efficiency and speed of operation compatible with low cost design objective.

When a card is completely embossed, as detected by a suitable code in the sorted data stored in the RAM 616 for that card, the CPU 612 is signalled to return the card to its reference position and then the pre-established horizontal and vertical displacement information is derived from the ROM 614 to enable the CPU 612 to control the servos for the card transport mechanism thereby to transport the card to the output stacker.

Any of various error conditions such as detected by an improper sequence of, or timing of, photocell outputs (e.g., such as those of the card picker/detector photocell sensor 315, 317) can serve to identify an error to the CPU 612, which responds by deflecting the card to the reject portion of the output stacker. Likewise, failure of any of the echo photocell detectors (indicating that a character was not mechanically embossed or not embossed properly) as well can provide an error output to the CPU 612. In any such error situation, or conversely when no error occurs, the CPU 612 issues a command to the actuating mechanism 144 for the output stacker to move the paddle and thereby cause deflection of the processed card into the corresponding reject or accept positions of the output stacker 106, as above described.

Conclusion

In conclusion, the present invention has been shown to afford a compact and relatively LOW cost, yet highly efficient and flexible embossing system which is fully automated in operation and affords a through-put rate satisfying the requirements of many applications. Whereas in the specifically disclosed embodiment, reference is made to embossing of plastic cards such as conventional credit cards, any suitable medium can readily be embossed and accordingly it is to be understood that reference to a card, or document hereinabove and in the claims which follow is intended to encompass any such alternative medium. As one example, a practical application of the present system has been for embossing metal plates such as used for various identification purposes such as in metal processing, such plates as well being found in use for vehicle identification and the like. Further, whereas an embossing wheel has been disclosed and is the preferred embodiment, the control system of the invention through its servo control loops and associated sensors, with suitable modifications, as well could be employed to control alternative forms of movable supports wherein the embossing elements are carried at locations which may be identified by corresponding addresses for selective control thereof in positioning a desired embossing punch and die pair with the medium thereafter being moved to receive embossing at each location as required. The disclosed embodiment does provide for card transport in what have been described as horizontal and vertical directions and these are to be understood as generic to and therefore encompassing the controlled movement of the transport system in a manner consistent with the inertial considerations for optimizing movement capabilities while minimizing the force necessary for accomplishing those transport functions. For example, a mechanical arrangement having alternative intertial considerations such that the inertia in the vertical direction is less than the horizontal would be controlled by the present system to perform the vertical transport operation more frequently than the horizontal. Further, reference to ascending addresses as to the type wheel signifies that the addresses of the embossing elements are ordered and, pursuant to the invention, a single rotation (cycle of movement) of the type wheel is all that is required for embossing the card with any desired ones of the punch and die elements in every desired location on the card. Further, it is to be appreciated that alternative schemes of processing of the data identifying the embossing to be performed may be developed and hence the processing as specifically disclosed, while preferred, is not to be deemed limiting in scope.

Numerous modifications and adaptations of the present invention will be apparent to those of skill in the art and hence it is intended by the appended claims to cover all such modifications and adaptations which fall within the true spirit and scope of the invention.

What is claimed is:

1. An output stacker mechanism for receiving processed documents and selectively stacking same in accept and reject portions thereof, comprising:

resilient engaging means defining first and second channels for receiving first and second edges of a document deposited in said output stacker at a position intermediate said accept and reject portions thereof, deflection means selectively positionable initially at one of first and second opposite sides of said resilient engaging means and selectively movable in first and second opposite directions to the respectively opposite said side, means for displacing said deflection means to a first of said two sides prior to deposit of a document therein and means for energizing said deflection means to deflect said deposited document in said first direction beyond said resilient engaging means and into said accept portion of said output hopper and, in response to an error indication, displacing said deflection means to said second side prior to depositing a document in said output hopper and thereafter energizing said deflection means to deflect said document deposited in said resilient engagement means in said second direction, beyond said resilient engaging means and into said reject hopper, thereby to physically separate the transported documents at said output stacker into said accept and reject portions, a pair of guide rails are provided, said resilient engaging means including a pair of movable detent mechanisms for providing the first and second channels, and each of the movable detent mechanisms are pivotally mounted on a guide rail.

2. An output stacker mechanism as recited in claim 1 wherein:

each of the pivotally mounted detent mechanisms including an upper portion and a lower portion, said upper portion having an angular extension thereon, said lower portion having an angular extension thereon, and both of said angular extensions cooperating to form a vertical engaging groove for an edge of the document.

3. An output stacker mechanism as recited in claim 1 wherein:

each one of the pair of guide rails is provided with a flat surface thereon, and the associated pivotally mounted detent mechanism is mounted on said respective flat surface.

4. An output stacker mechanism as recited in claim 3 wherein:

a stop is provided for each pivotally mounted detent mechanism, and adjustable means is arranged on each detent mechanism for contact with each associated stop for controlling the extent of pivoting motion of the associated detent mechanism.

5. An output stacker mechanism as recited in claim 4 wherein:

each of the pivotally mounted detent mechanisms further including an upper portion and a lower portion, said upper portion having an angular extension thereon, said lower portion having an angular extension thereon, and both of said angular extensions cooperating to form a vertical engaging groove for an edge of the document.

6. An output stacker mechanism for receiving processed documents and selectively stacking same in accept and reject portions thereof, comprising:

resilient engaging means defining first and second channels for receiving first and second edges of a document deposited in said output stacker at a position intermediate said accept and reject portions thereof;

deflection means selectively positionable initially at one of first and second opposite sides of said resilient engaging means and selectively movable in first and second opposite directions to the respectively opposite said side, means for displacing said deflection means to a first of said two sides prior to deposit of a document therein and means for energizing said deflection means to deflect said deposited document in said first direction beyond said resilient engaging means and into said accept portion of said output hopper and, in response to an error indication, displacing said deflection means to said second side prior to depositing a document in said output hopper and thereafter energizing said deflection means to deflect said document deposited in said resilient engagement means in said second direction, beyond said resilient engaging means and into said reject hopper, thereby to physically separate the transported documents at said output stacker into said accept and reject portions, said means for displacing said deflection means including an electric motor, an eccentric driven by the electric motor, said deflection means including a reciprocal paddle, and connecting actuating mechanism between the eccentric and the reciprocal paddle, and guide means being associated with the movable paddle to align and constrain same in the direction of desired reciprocating movement.

7. An output stacker mechanism as recited in claim 6 wherein:

a gear box is provided between said motor and said eccentric with an output from the gear box for driving a notched photocell disc, and a photocell sensor is associated with the disc for providing an indication of the paddle position.

* * * * *

UNITED STATES PATENT AND TRADEMARK OFFICE

CERTIFICATE OF CORRECTION

PATENT NO. : 4,271,012

DATED : June 2, 1981

INVENTOR(S) : LaManna et al

It is certified that error appears in the above—identified patent and that said Letters Patent is hereby corrected as shown below:

Column 3, line 22, "8A" s/b --8B--.

Column 7, line 7, after "tem" insert --100--;
line 24, "rals" s/b --rails--.

Column 8, line 18, "180" s/b --181--;
*line 23, "192, 194 and 196" s/b --192 and 194, 196--;
line 47, "throught" s/b --through--.

Column 9, line 12, "ril" s/b --rail--.

Column 10, line 38, "108" s/b --180--.

Column 12, line 48, "426', 432'" s/b --426, 432--;
line 52, "4909" s/b --409--.

Column 14, line 1, "150'''" s/b/ --150--;
line 2, "150a'''" s/b --150a--;
line 3, "160'' and 162'''" s/b --160 and 162--;
line 4, "108'''" s/b --108--;
line 5, "152" s/b --152--;
line 8, "150'''" s/b --150, 152--;
line 9, "172'''" s/b --172--, "164'''" s/b --164--;
line 11, "171'''" s/b --171--;

UNITED STATES PATENT AND TRADEMARK OFFICE

CERTIFICATE OF CORRECTION

PATENT NO. : 4,271,012

DATED : June 2, 1981

INVENTOR(S) : LaManna et al

It is certified that error appears in the above—identified patent and that said Letters Patent is hereby corrected as shown below:

line 12, "160'' and 162''" s/b --160 and 162--;
line 14, "165''" s/b --165--;
line 15, "165''" s/b --165--;
line 16, "172''" s/b --172--;
line 17, "108''" s/b --108--;
line 19, "172''" s/b --172--;
line 23, "165''" s/b --165--;
line 28, "152''" s/b --152--.

Column 15, line 18, "9B" s/b --9A--;
line 46, after "punch" isnert --shank--;
line 56, "585b" s/b --585a--.

Column 16, line 1, "retractors" s/b --retractor--;
line 18, after "bail" insert --arm--.

Column 17, line 8, further" s/b --forward--;
line 27, "shanks" s/b --shank--;
line 29, "shanks" s/b --shank--;
line 32, "shanks" s/b --shank--;
line 36, "shanks" s/b --shank--;
line 48, "130''" s/b --130--.

Column 18, line 20, "defects" s/b --detects--.

Column 19, line 53, "or transfer system 130''" s/b --on transport system 130--.

Column 20, line 7, "represented" s/b --representing--;
line 19, "buttoms" s/b --buttons--;
line 24, "buttom" s/b --button--.

UNITED STATES PATENT AND TRADEMARK OFFICE

CERTIFICATE OF CORRECTION

PATENT NO. : 4,271,012

DATED : June 2, 1981

INVENTOR(S) : LaManna et al

It is certified that error appears in the above—identified patent and that said Letters Patent is hereby corrected as shown below:

Column 21, line 18, "botton" s/b --button--.

Column 22, line 60, "inertial" s/b --inertia--.

Column 24, line 7, after "in" insert --the--;
line 53, "associated" s/b --association--.

Column 25, line 52, "it supper" s/b --its upper--.

Column 28, line 14, "(.e.g, 64)" s/b --e.g., 64)--.

Signed and Sealed this

*Thirty-first* Day of *August 1982*

[SEAL]

*Attest:*

GERALD J. MOSSINGHOFF

*Attesting Officer* *Commissioner of Patents and Trademarks*